US010599093B1

(12) United States Patent
Uehashi et al.

(10) Patent No.: US 10,599,093 B1
(45) Date of Patent: Mar. 24, 2020

(54) IMAGE FORMATION APPARATUS

(71) Applicant: Oki Data Corporation, Tokyo (JP)

(72) Inventors: Tetsuya Uehashi, Tokyo (JP); Yuu Oikawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/445,205

(22) Filed: Jun. 19, 2019

(30) Foreign Application Priority Data

Aug. 29, 2018 (JP) ..... 2018-160634
Apr. 26, 2019 (JP) ..... 2019-085099

(51) Int. Cl.
*G03G 21/16* (2006.01)
*G03G 15/00* (2006.01)
(Continued)

(52) U.S. Cl.
CPC ..... *G03G 21/1685* (2013.01); *B65H 31/00* (2013.01); *G03G 15/0142* (2013.01); *G03G 15/2017* (2013.01); *G03G 15/6529* (2013.01); *G03G 15/6552* (2013.01); *G03G 15/6555* (2013.01); *G03G 15/6573* (2013.01); *G03G 21/1604* (2013.01); *G03G 21/1609* (2013.01); *G03G 21/1619* (2013.01); *G03G 21/1628* (2013.01); *G03G 21/1633* (2013.01); *G03G 21/1638* (2013.01); *B65H 2402/441* (2013.01); *G03G 2215/0054* (2013.01);
(Continued)

(58) Field of Classification Search
CPC ..... G03G 15/0142; G03G 15/2017; G03G 15/6529; G03G 15/6552; G03G 15/6555; G03G 15/6573; G03G 21/1604; G03G 21/1609; G03G 21/1619; G03G 21/1628; G03G 21/1633; G03G 21/1638; G03G 21/1685; G03G 2215/00421; G03G 2215/0054; G03G 2215/00544; G03G 2215/2003; G03G 2221/1639; G03G 2221/1672; G03G 2221/1678; G03G 2221/1684; G03G 2221/1687; G03G 2221/169; G03G 2221/1846; B65H 31/00; B65H 2402/441
See application file for complete search history.

(56) References Cited

U.S. PATENT DOCUMENTS 6,292,638 B1 * 9/2001 Nagamine ..... G03G 15/2035 399/122
2006/0008294 A1 * 1/2006 Ito ..... G03G 21/1604 399/122
2013/0121708 A1 * 5/2013 Yoo ..... G03G 15/2035 399/21

FOREIGN PATENT DOCUMENTS

JP 2008-033295 A 2/2008

* cited by examiner

*Primary Examiner* — Joseph S Wong
(74) *Attorney, Agent, or Firm* — Metrolex IP Law Group, PLLC

(57) ABSTRACT

An image formation apparatus according to an embodiment may include: an apparatus housing including a stacker formed on a periphery of the apparatus housing, wherein the stacker includes an opening; an image formation part provided in the apparatus housing and configured to form an image on a medium; and a fixation unit detachably attached in the apparatus housing and configured to fix the image formed by the image formation part on the medium, wherein in a state where the fixation unit is attached in the apparatus housing, a part of the fixation unit is exposed through the opening of the stacker to constitute a part of the stacker such that the opening of the stacker allows the fixation unit to be taken out from the apparatus housing therethrough.

17 Claims, 12 Drawing Sheets

(51) Int. Cl.
*B65H 31/00* (2006.01)
*G03G 15/20* (2006.01)
*G03G 15/01* (2006.01)

(52) U.S. Cl.
CPC ..... *G03G 2215/00421* (2013.01); *G03G 2215/00544* (2013.01); *G03G 2215/2003* (2013.01); *G03G 2221/169* (2013.01); *G03G 2221/1639* (2013.01); *G03G 2221/1672* (2013.01); *G03G 2221/1678* (2013.01); *G03G 2221/1684* (2013.01); *G03G 2221/1687* (2013.01); *G03G 2221/1846* (2013.01)

IMAGE FORMATION APPARATUS

CROSS REFERENCE TO RELATED APPLICATIONS

This application claims priority based on 35 USC 119 from prior Japanese Patent Application No. JP2018-160634 filed on Aug. 29, 2018, entitled "IMAGE FORMATION APPARATUS" and JP2019-085099 filed on Apr. 26, 2019, entitled "IMAGE FORMATION APPARATUS", the entire contents of which are incorporated herein by reference.

BACKGROUND

The disclosure relates to an image formation apparatus and may be suitably applied to an electrophotographic image formation apparatus.

In a related art, an image formation apparatus, such as a copy machine, a printer, or a facsimile, configured to form an image using an electrophotographic method, forms a developer image, transfers the developer image to a medium, and then fix the transferred developer image to the medium by a fixation unit (See for example, Patent Document 1). The electrophotographic image formation apparatus includes the fixation unit accommodated in an apparatus housing, which is closed by an apparatus cover. When the fixation unit needs to be taken out from the apparatus housing due to a paper jam or the like, a user opens the apparatus cover expose the fixation unit to the outside of the apparatus housing, and then takes out the fixation unit from the apparatus housing.

Patent Document 1: Japanese Patent Application Laid-Open No. 2008-33295

SUMMARY

As described above, in the image formation apparatus of the related art, the fixation unit cannot be removed from the apparatus housing without opening the apparatus cover. Accordingly, an operation of removing the fixation unit from the apparatus housing may be inefficient. In other words, if the fixation unit is able to be removed from the apparatus housing without opening the apparatus cover, an efficiency of operation of removing the fixation unit may improve.

An object of an aspect of an embodiment may be to provide an image formation apparatus that can improve an efficiency of operation of removing a fixation unit.

An aspect of an embodiment may be an image formation apparatus that may include: an apparatus housing including a stacker formed on a periphery of the apparatus housing, wherein the stacker includes an opening; an image formation part provided in the apparatus housing and configured to form an image on a medium; and a fixation unit detachably attached in the apparatus housing and configured to fix the image formed by the image formation part on the medium, wherein in a state where the fixation unit is attached in the apparatus housing, a part of the fixation unit is exposed through the opening of the stacker to constitute a part of the stacker such that the opening of the stacker allows the fixation unit to be taken out from the apparatus housing therethrough.

According to the above aspect, it may provide the image formation apparatus that can improve an efficiency of operation of removing the fixation unit.

DETAILED DESCRIPTION

Figure 1:
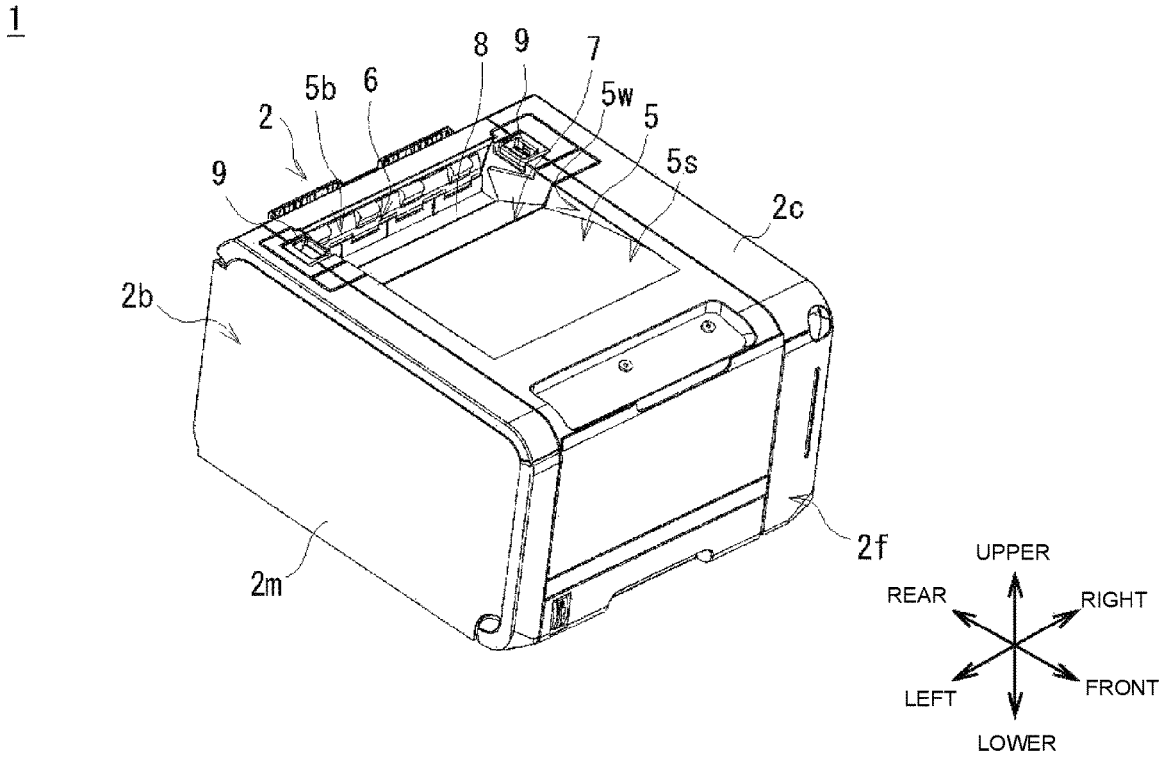
FIG. 1 is a diagram illustrating a view of an exterior configuration of an image formation apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All the drawings are provided to illustrate the respective examples only.

[1. Configuration of Image Formation Apparatus]

Figure 2:
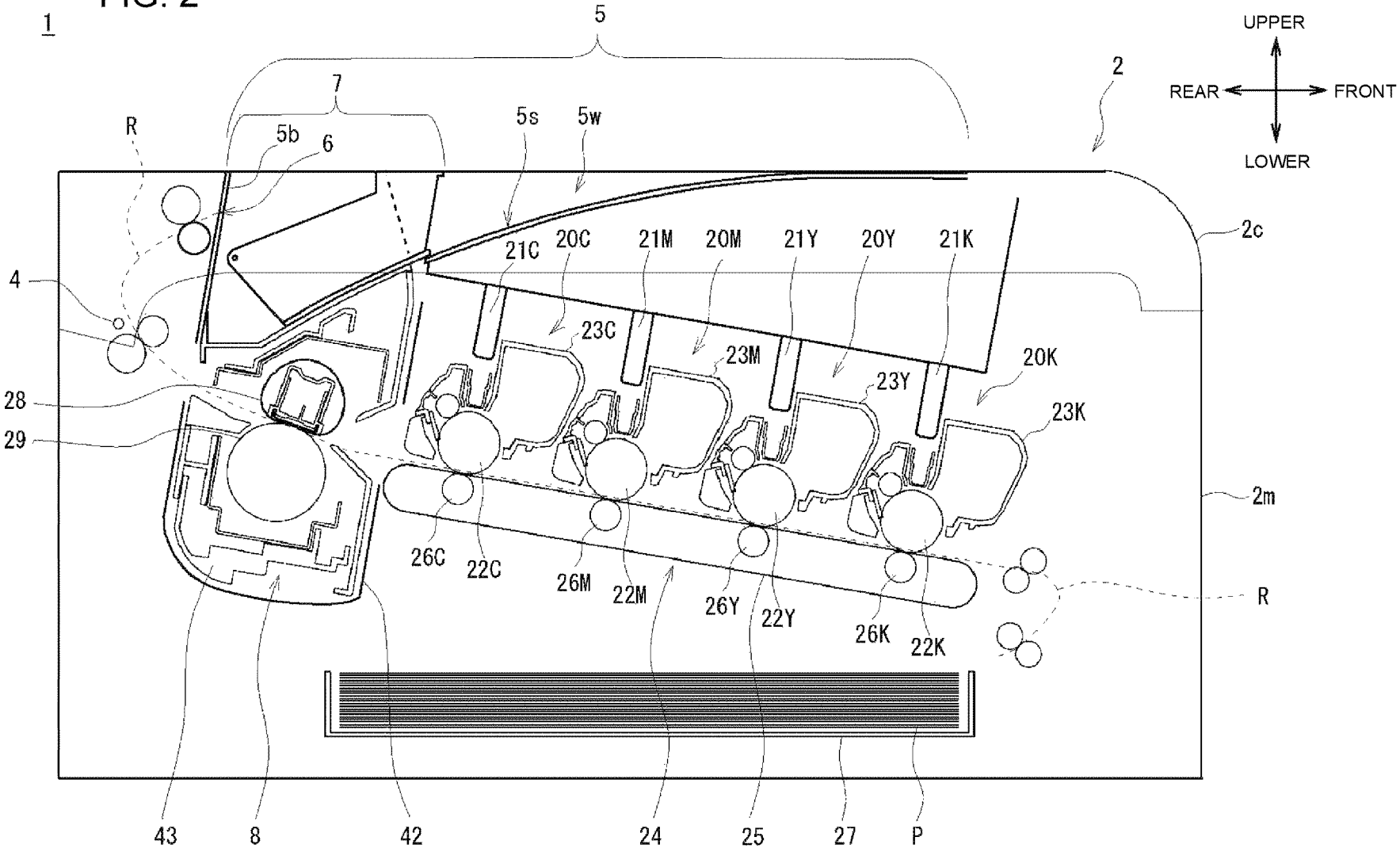
FIG. 2 is a diagram illustrating a cross-sectional side view illustrating an internal configuration of an image formation apparatus, such as being illustrated in FIG. 1.

FIGS. 1 and 2 illustrate a configuration of an image formation apparatus 1 according to one or more embodiments. The image formation apparatus 1 is an electrophotographic printer which forms (prints) an image on a sheet, such as paper, serving as a medium. Note that FIG. 1 is a diagram illustrating a view of an exterior configuration of the image formation apparatus 1 and FIG. 2 is a diagram illustrating a cross-sectional side view of an internal configuration of the image formation apparatus 1.

First, the exterior configuration of the image formation apparatus 1 is explained. As illustrated in FIG. 1, the image formation apparatus 1 includes an apparatus housing 2 having, for example, substantially a cuboid or a rectangular shape, as an exterior thereof. Note that in this disclosure, a direction from a front surface 2*f* toward a rear surface 2*b* of the apparatus housing 2 is referred to as a rear direction, a direction from the rear surface 2*b* toward the front surface 2*f* of the apparatus housing 2 is referred to as a front direction, a direction from a lower side toward a upper side of the apparatus housing 2 is referred to as an upper direction, a direction from the upper side toward the lower side of the apparatus housing 2 is referred to as a lower direction, a direction from a right side toward a left side of the apparatus housing 2 is referred to as a left direction, and a direction from the left side toward the right side of the apparatus housing 2 is referred to as a right direction.

Figure 3:
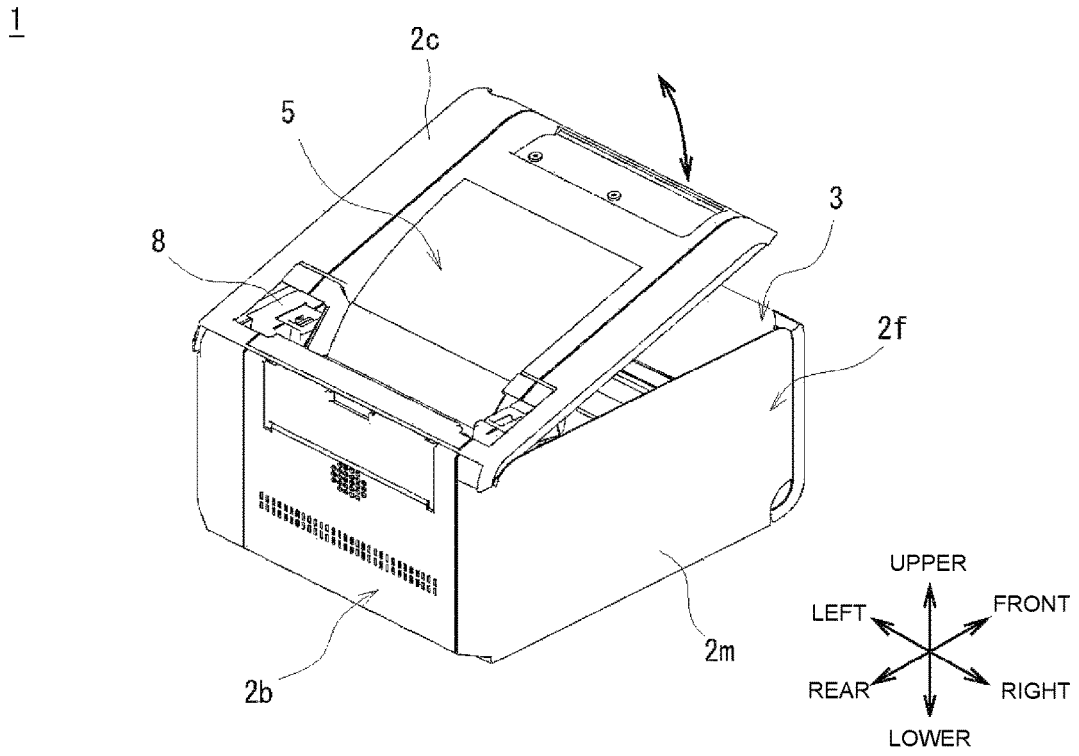
FIG. 3 is a diagram illustrating a perspective view of an external configuration of the image formation apparatus upon opening an apparatus cover.

The apparatus housing 2 includes a housing main body 2*m* and an apparatus cover 2. The housing main body 2*m* is formed in a substantially box shape and includes an opening 3 (hereinafter may be referred to as a main body opening 3) at a top of the apparatus housing 2*m* (see FIG. 3). The apparatus cover 2 constitutes the top or the top surface of the apparatus housing 2 and functions as a lid, which covers the main body opening 3. As illustrated in FIG. 2, the apparatus cover 2*c* includes a rotational shaft 4 extending in the left-right direction at the rear end portion of the apparatus cover 2, such that the rotational shaft 4 is rotatably supported by a support portion or a bearing portion (not illustrated) provided at a rear upper end portion of the housing main body 2*m*. With this, the apparatus cover 2*c* is rotatable about the rotational shaft 4 (not illustrated in FIG. 3) as illustrated in FIG. 3, such that when the apparatus cover 2*c* rotates in a direction that the front side of the apparatus cover 2*c* moves away from the housing main body 2*m*, the apparatus cover 2*c* open the opening 3 of the housing main body 2*m*, whereas when the apparatus cover 2*c* rotates in a direction that the front side of the apparatus cover 2*c* moves closer to the housing main body 2*m*, the apparatus cover 2*c* closes the opening 3 of the housing main body 2*m*. In a state where the apparatus cover 2*c* is opened, the inside of the image formation apparatus 1 is exposed through the opening 3 of the housing main body 2*m* and thus is able to be reached from the outside.

Note that in this disclosure, a state in which the apparatus cover 2*c* fully closes the opening 3 of the housing main body 2*m* as illustrated in FIG. 1 is referred to as a closed state of the apparatus cover 2*c*, whereas a state in which the apparatus cover 2*c* fully opens the opening 3 of the housing main body 2*m* at the maximum rotational degree to expose the inside of the apparatus 1 as illustrated in FIG. 3 is referred to as an open state of the apparatus cover 2*c*.

As illustrated in FIGS. 1 and 2, the top portion of the apparatus cover 2*c* is formed with a recess, which forms a stacker 5 in which the sheets are to be stacked (accumulated). That is, the apparatus cover 2*c* includes the stacker 5 at the top portion thereof which is a part of the outer periphery of the apparatus housing 2. The stacker 5 includes a stacking surface 5*s* (a bottom surface of the stacker 5) on which the sheets are to be stacked, wherein the stacking surface 5*s* is inclined such that the stacking surface 5*s* gradually rises as far from the rear end to the front end thereof. The image formation apparatus 1 includes a sheet discharge port 6 at a rear wall 5*b* of the stacker 5, such that the sheets discharged from the sheet discharge port 6 toward the front direction are stacked on the stacking surface 5*s* of the stacker 5.

The apparatus cover 2*c* includes an opening 7 (hereinafter may be referred to as a cover opening) at the rear portion of the stacker 5. The opening 7 provided in the apparatus cover 2*c* is an elongate opening extending in the left-right direction, which extends from the rear portion of the stacker 5 to side portions with respect to the rear portion of the stacker 5 in the left-right direction.

A top surface of a fixation unit 8, which is detachably attached to the housing main body 2*m*, is exposed to the outside of the image formation apparatus 1 through the opening 7 of the apparatus cover 2*c*. Note that the fixation unit 8 is explained in detail later. The top surface of the fixation unit 8 fills or closes the opening 7 of the apparatus cover 2*c*, and constitutes a rear portion of the stacker 5 and the left and right side portions with respect to the rear portion of the stacker 5. The rear portion of the stacker 5 includes a rear portion of the stacking surface 5*s* and a rear portion of each of left and right side walls 5*w* and 5*w* of the stacker 5. Note that a part of the housing main body 2*m* forms the rear wall 5*b* of the stacker 5. That is, the apparatus cover 2*c* and the fixation unit 8 form the stacking surface 5*s* and the side walls 5*w* of the stacker 5, whereas the housing main body 2*m* forms the rear wall 5*b* of the stacker 5.

The top surface of the fixation unit 8 includes handles 9 at the left and right side with respect to the stacker 5. As in the perspective view of FIG. 4, the fixation unit 8 attached to the housing main body 2*m* can be taken out from the apparatus housing through the opening 7 of the apparatus cover 2*c*, by upwardly pulling the handles 9 exposed through the opening 7 of the apparatus cover 2*c* while leaving the apparatus cover 2*c* in the closed state.

At a predetermined position(s) of the housing main body 2*m* and/or the apparatus cover 2*c*, various types of operation buttons and a display panel (not illustrated in FIG. 1) are provided to receive touch operations and display various information. At a predetermined position(s) of the apparatus cover 2*c*, a handle(s) (not illustrated in FIG. 1) is provided to open or close the apparatus cover 2*c*.

The interior configuration of the image formation apparatus 1 is explained as follows. As illustrated in FIG. 2, parts or components of the image formations apparatus 1 are provided along a conveyance path R in which the sheets P is to be conveyed in the apparatus housing 2. Specifically, four image forming unit 20 (20K, 20Y, 20M, and 20C) are arranged along the conveyance path R in the front-rear direction at an approximately middle position in the height of the apparatus housing 2, which respectively use four colors of developers (for example, four colors of black (K), yellow (Y), magenta (M), and cyan (C)).

Each image forming unit 20 (20K, 20Y, 20M, and 20C) includes a LED head 21 (21K, 21Y, 21M, and 21C), a photosensitive drum 22 (22K, 22Y, 22M, and 22C), and a toner container 23 (23K, 23Y, 23M, and 23C). Each image forming unit 20 is a device or a hardware that emits light from the LED head 21 to the surface of photosensitive drum 22 to form an electrostatic latent image on the surface of photosensitive drum 22, and supplies a toner from the toner container 23 to the electrostatic latent image to attach the toner to the electrostatic latent image, thereby forming a toner image on the surface of the photosensitive drum 22.

In the apparatus housing 2, a transfer unit 24 is provided below the four image forming units 20. The transfer unit 24 includes an endless conveyance belt 25 a part of which is capable of running along the conveyance path R in the front-rear direction and transfer rollers 26 (26K, 26Y, 26M, and 26C) provided below and opposed to the photosensitive drums 22 (22K, 22Y, 22M, and 22C) with the conveyance belt 25 sandwiched therebetween, respectively.

Each of transfer rollers 26 is a member that transfers the toner image formed on the photosensitive drum 22 to the sheet P passing between the conveyance belt 25 and the photosensitive drum 22, by charging the sheet P in a polarity opposite to that of the toner.

In the apparatus housing 2, a sheet tray 27 is provided below the transfer unit 24 (for example, in a lower portion of the apparatus housing 2), which accommodates therein the sheets P. In the apparatus housing 2, conveying roller pairs or the like to feed or convey the sheet P are provided along the conveyance path R between the sheet tray 27 and the transfer unit 24.

In the apparatus housing 2, the fixation unit 8 is provided downstream of the transfer unit 24 in the sheet conveyance direction (for example, provided at a rear side of the transfer unit 24). The fixation unit 8 is a device that includes a heat roller 28 and a backup roller 29 provided below and opposed to the heat roller 28 with the conveyance path R in between. The fixation unit 8 fixes the toner image transferred to the sheet P by the transfer unit 24 to the sheet P, by heating and pressing the sheet P by means of the heat roller 28 and the backup roller 29.

In the apparatus housing 2, a pair of discharging rollers or the like, configured to discharge the sheet P from the discharge port 6 to the stacker 5, is provided between the fixation unit 8 and the sheet discharge port 6 in the conveyance path R.

Note that the image formation apparatus 1 is provided such that most or all of the components or parts other than the sheet tray 27 are tilted with respect to the bottom surface of the apparatus housing 2 as illustrated in FIG. 2. For example, the four image forming units 20 and the fixation unit 8 are tilted toward the front side of the apparatus housing 2 with respect to the bottom surface of the apparatus housing 2 and are disposed at positions in height different from each other. With this configuration, the length of the image formation apparatus 1 in the front-rear direction can be downsized compared to the case in which the components or parts other than the sheet tray 27 or the four image forming units 20 and the fixation unit 8 are provided in parallel to the bottom surface of the apparatus housing 2.

[2. Configurations Around the Apparatus Cover and the Fixation Unit]

Next, configurations around the apparatus cover 2*c* and the fixation unit 8 are described in detail below. Note that the following description is made only for configurations related to operations of opening and closing of the apparatus cover 2*c* and removing of the fixation unit 8, among the configurations of the apparatus cover 2*c*, the fixation unit 8, and parts therearound.

Figure 5:
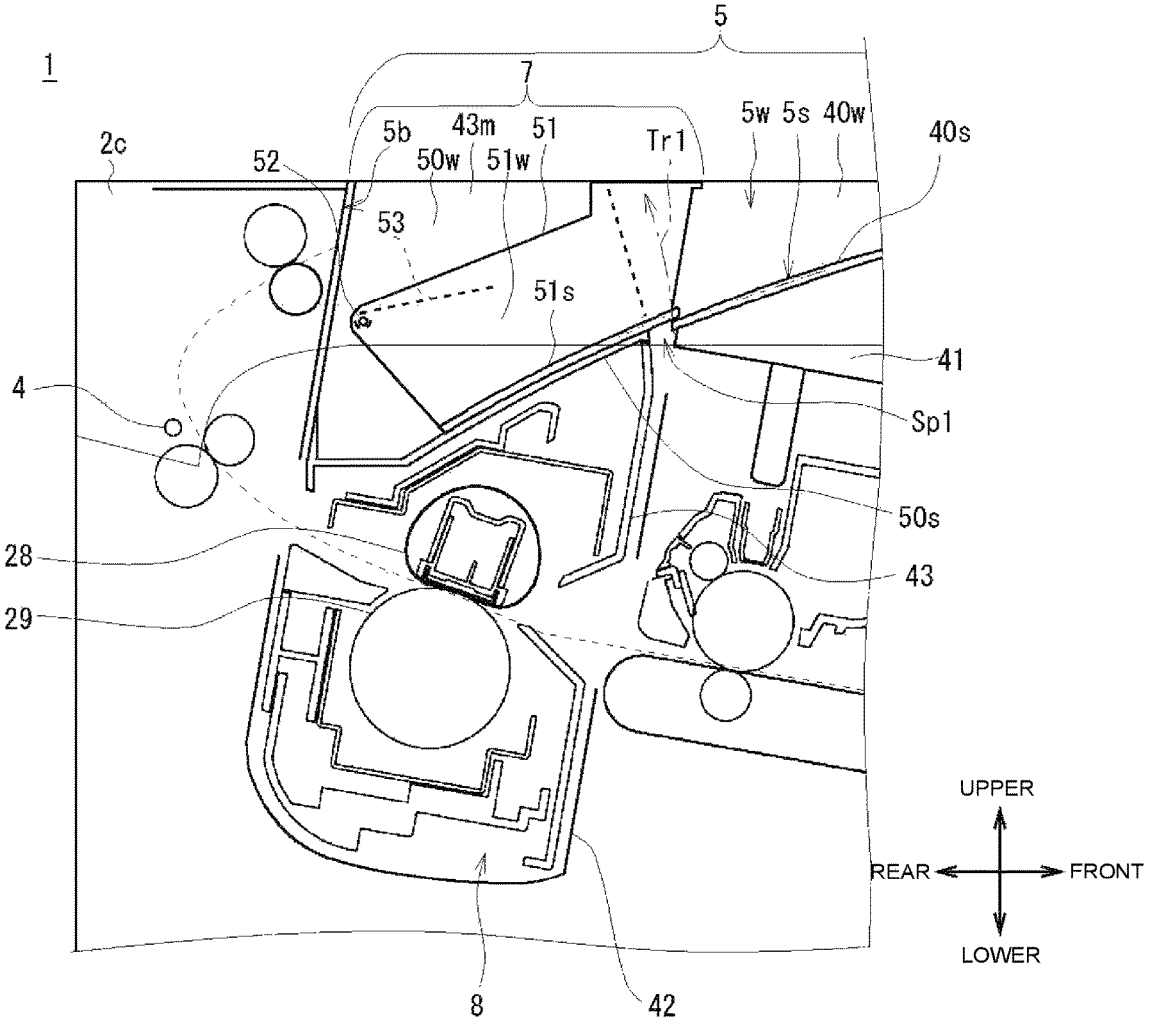
FIG. 5 is a diagram illustrating an enlarged cross-sectional view of a portion around the apparatus cover and the fixation unit.

FIG. 5 illustrates the configurations around the apparatus cover 2*c* and the fixation unit 8. Note that FIG. 5 is a diagram illustrating an enlarged cross-sectional view of configurations around the apparatus cover 2*c* and the fixation unit 8, in the state where the apparatus cover 2*c* is closed and the fixation unit 8 is attached to the housing main body 2*m*.

As illustrated in FIG. 5, the apparatus cover 2*c* is rotatable such that the rotational shaft 4 is provided at the rear end portion of the apparatus cover 2*c* and is rotatably supported by the support portion or the bearing portion (not illustrated) provided at the rear upper end portion of the housing main body 2*m*. Specifically, the rotational shaft 4 is provided on a rear side with respect to the rear wall 5*b* of the stacker 5. The apparatus cover 2*c* is opened and closed by being rotated about the rotational shaft 4.

The apparatus cover 2*c* is formed with the stacker 5 at the top portion thereof. The stacker 5 is formed with the opening 7 at the rear portion thereof. The size of the opening 7 is the approximately the same as the size of the top surface of the fixation unit 8. The opening 7 is an elongate hole extending from the rear portion of the stacker 5 to the side portions with respect to the rear portion of the stacker 5 in the left-right direction. Note that among the entire of the apparatus cover 2*c*, a portion 40*s* of the apparatus cover 2*c* that forms a front portion of the stacking surface 5*s* of the stacker 5 is referred to as a stacking surface section 40*s*, whereas portions 40*w* of the apparatus cover 2*c* that form front portions of the left and right side walls 5*s* of the stacker 5 are referred to as side wall sections 40*w*. That is, the opening 7 is provided between the rear wall 5*b* of the stacker 5 and the stacking surface section 40*s* and the side wall section 40*w*.

A part of the components in the apparatus housing 2 is assembled to be an apparatus cover assembly 41 and the apparatus cover assembly 41 is attached below the stacking surface section 40*s* of the apparatus cover 2*c*. That is, the apparatus cover 2*c* is opened and closed together with the apparatus cover assembly 41. Note that the apparatus cover assembly 41 includes the LED head 21 for each image forming unit 20.

The housing main body 2*m* includes a fixation unit accommodation section 42 to detachably accommodate therein the fixation unit 8 below the opening 7 of the closed apparatus cover 2*c*.

Figure 4:
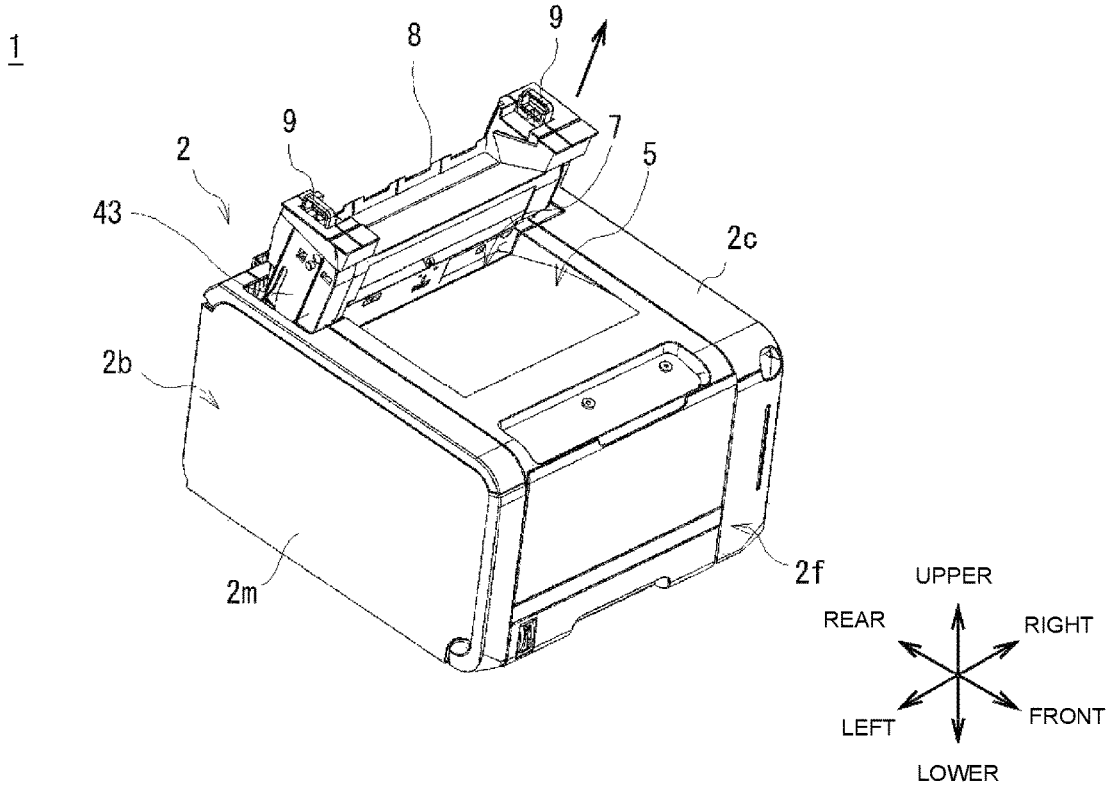
FIG. 4 is a diagram illustrating a perspective view of an external configuration of the image formation apparatus upon removing a fixation unit.

The fixation unit 8 includes a fixation unit housing 43 as an exterior of the fixation unit 8, which has a cuboid shape a longitudinal direction of which extends in the left-right direction, as illustrated in FIG. 4. The fixation unit housing 43 is accommodated in the fixation unit accommodation section 42 of the housing main body 2*m* such that a top surface of the fixation unit housing 43 is exposed to the outside of the housing through the opening 7 of the apparatus cover 2*c*. Note that the fixation unit accommodation section 42 accommodates therein the fixation unit housing 43 such that the fixation unit housing 43 is tilted toward the front direction of the apparatus housing 2. The fixation unit housing 43 can be removed from the apparatus housing 2 by pulling the fixation unit housing 3 obliquely upward in the front direction. The top surface of the fixation unit housing 43, which is to be the exposed portion, includes a recess portion recessed at a center portion thereof from both sides thereof in the left-right direction. The recess portion of the top surface of the fixation unit housing 43 constitutes the rear portion of the stacker 5, which comprises the rear portion of the stacking surface 5*s* and the rear portions of the left and right side walls 5*w* of the stacker 5.

The top of the fixation unit housing 43, which constitutes the rear portion of the stacker 5 and the left and right side portion thereof, is composed of a fixation unit cover 43*m*. Among the entire of the fixation unit cover 43*m*, a portion 50*s* of the fixation unit cover 43*m* that forms the stacking surface 5*s* of the stacker 5 is referred as a stacking surface section 50*s*, whereas a portion 50*w* of the fixation unit cover 43*m* that forms the side walls 5*w* is referred to as a side wall sections 50*w*. The stacking surface section 50*s* and the side wall sections 50*w* of the fixation unit cover 43*m* are flush with or provide at a plane same as the stacking surface section 40*s* and the side wall sections 40*w* of the apparatus cover 2*c*, respectively. The stacking surface section 50*s* and the side wall sections 50*w* of the fixation unit cover 43*m* and the stacking surface section 40*s* and the side wall sections 40*w* of the apparatus cover 2*c* make up the stacker 5. The fixation unit cover 43*m* is provided with the handles 9 (see FIG. 1) at left and right sides of the stacker 5.

In order to prevent the apparatus cover assembly 41 attached to the lower surface of the stacking surface section 40*s* of the apparatus cover 2*c*, which has a thickness (height) in the vertical direction, from interfering with the fixation unit housing 43 upon opening or closing the apparatus cover 2*c*, the image formation apparatus 1 includes a gap Sp1 between a rear end of the stacking surface section 40*s* of the closed apparatus cover 2*c* and a front end of the stacking surface section 50*s* of the fixation unit housing 43 accommodated in the fixation unit accommodation section 42. That is, the fixation unit housing 43 is provided at a rear side or outside of a rotational trajectory Tr1 of the apparatus cover assembly 41.

Note that because there is the gap Sp1 between the stacking surface section 40*s* of the apparatus cover 2*c* and the stacking surface section 50*s* of the fixation unit cover 43*m* as described above, it may be possible that the sheet(s) P discharged on the stacker 5 or a foreign object(s) may enter into the apparatus housing 2 through the gap Sp1.

In light of this, in addition to the fixation unit cover 43*m*, a sub cover 51 for covering the gap Sp1 is attached to the top surface of the fixation unit housing 43. The sub cover 51 is attached to the fixation unit cover 43*m* and covers a front portion of the fixation unit cover 43*m*. That is, the front side of the top surface of the fixation unit housing 43 has a dual structure having the fixation unit cover 43*m* and the sub cover 51, and these fixation unit cover 43*m* and sub cover 51 constitute the rear portion of the stacker 5. Note that among the entire of the sub cover 51, a portion of the sub cover 51 that forms the stacking surface 5*s* of the stacker 5 is referred to as the stacking surface section 51*s* and portions of the sub cover 51 that form the side walls 5*w* are referred to as side wall sections 51*s*.

The sub cover 51 is rotatable such that the rotational shaft 52 of the sub cover 51 extending between the rear end portions of the left and right side wall sections 51*s* in the left-right direction is rotatably supported by support portions or bearing portions (not illustrated) provided at the rear portion of the side wall section 50*w* of the fixation unit cover 43*m*. Note that the rotational shaft 52 of the sub cover 51 is provided on a front side with respect to the rear wall 5*b* of the stacker 5 and an upper side with respect to the rotational shaft 4. In other words, the rotational shaft 52 of the sub cover 51 is provided at a portion of the fixation unit cover 43*m* on the opposite side (rear side) from the gap Sp1.

Figure 6:
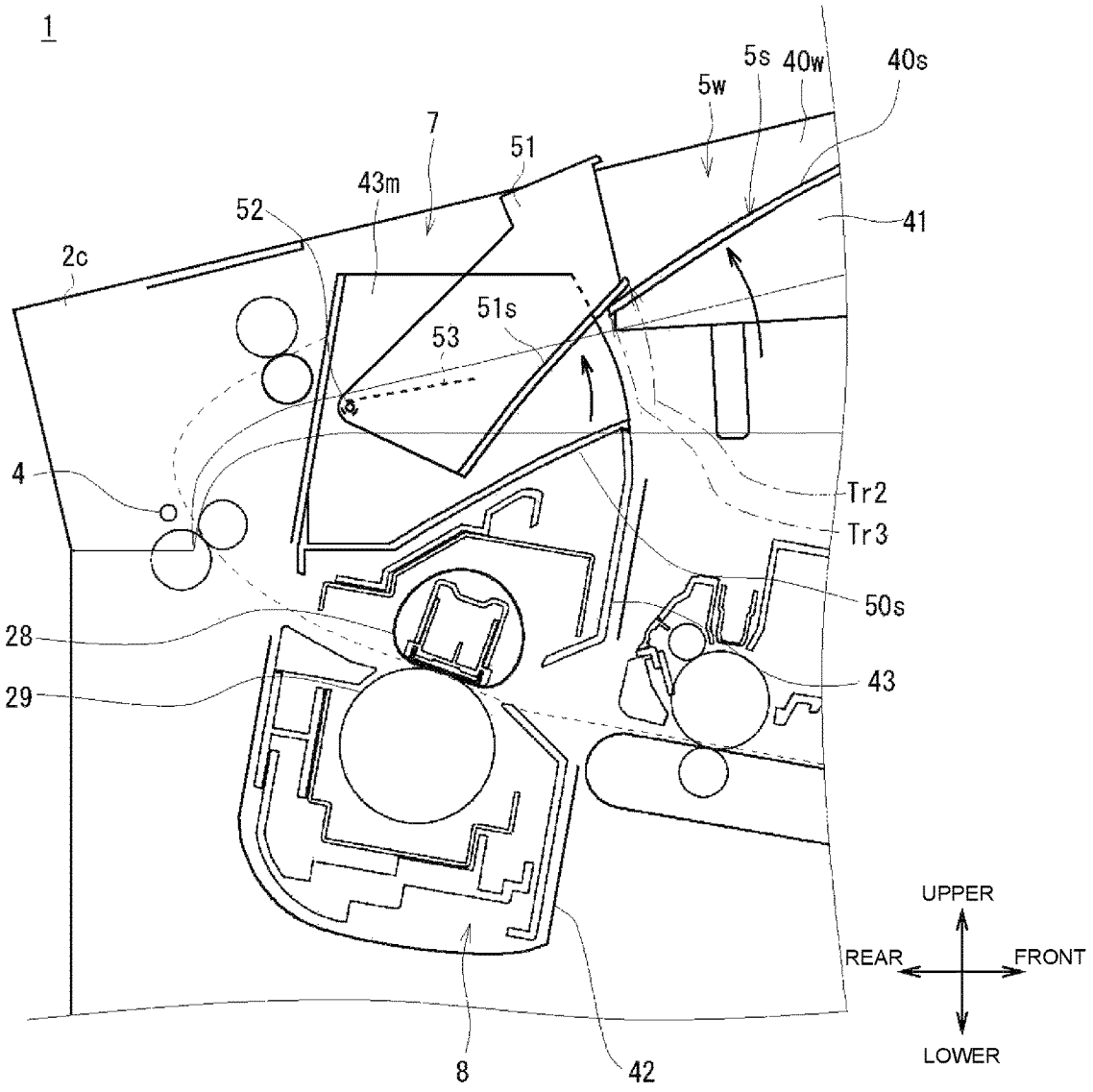
FIG. 6 is a diagram illustrating an enlarged cross-sectional view for explaining movements of components when a sub cover is opened together with the apparatus cover.

With this configuration, as illustrated in FIGS. 5 and 6, the sub cover 51 is opened by being rotated about the rotational shaft 52 of the sub cover 51 in a direction (a counterclockwise direction in FIG. 6) that the stacking surface section 51*s* of the sub cover 51 moves away from the stacking surface section 50*s* of the fixation unit cover 43*m*, whereas the sub cover 51 is closed by being rotated about the rotational shaft 52 of the sub cover 51 in a direction (a clockwise direction in FIG. 6) that the stacking surface section 51*s* of the sub cover 51 moves closer to the stacking surface section 50*s* of the fixation unit cover 43*m*. Note that a state in which the stacking surface section 51*s* of the sub cover 51 is in contact with or adjacent to the stacking surface section 50*s* of the fixation unit cover 43*m* as illustrated in FIG. 5 is referred to as a closed state of the sub cover 51, whereas a state in which the stacking surface section 51*s* of the sub cover 51 is away from the stacking surface section 50*s* of the fixation unit cover 43*m* as illustrated in FIG. 6 is referred to as an opened state of the sub cover 51.

The sub cover 51 is biased, by means of the torsion spring 53 attached to the rotational shaft 52 of the sub cover 51, in a direction that the stacking surface section 51*s* of the sub cover 51 moves closer to the stacking surface section 50*s* of the fixation unit cover 43*m* (in a closing direction). Specifically, one of arms of the torsion spring 53 is fixed to the fixation unit cover 43*m* and the other arm of the torsion spring 53 is fixed to the rotational shaft 52 of the sub cover 51, such that the torsion spring 53 applies the biasing force that causes the sub cover 51 to close.

As illustrated in FIG. 5, the sub cover 51 is projected further in the front direction than the fixation unit cover 43*m*. The front end of the front end portion of the stacking surface section 51*s* is provided over and overlapped with the stacking surface section 40*s* of the apparatus cover 2*c*, which is provided on a front side from the stacking surface section 50*s* of the fixation unit cover 43*m*. That is, the stacking surface section 51*s* of the sub cover 51 is overlapped with both of the front end portion of the stacking surface section 50*s* of the fixation unit cover 43*m* and the rear end portion of the stacking surface section 40*s* of the apparatus cover 2*c*, so as to cover the gap Sp1 between the stacking surface section 40*s* of the apparatus cover 2*c* and the stacking surface section 50*s* of the fixation unit cover 43*m*. In other words, the stacking surface 5*s* of the stacker 5 is formed without any gap by means of a combination of the stacking surface section 40*s* of the apparatus cover 2*c*, the stacking surface section 51*s* of the sub cover 51, and the stacking surface section 50*s* of the fixation unit cover 43*m*.

As illustrated in FIG. 6, the front end portion of stacking surface section 51*s* of the sub cover 51 is provided over and overlapped with the stacking surface section 40*s* of the apparatus cover 2*c* as described above. With this, upon opening the apparatus cover 2*c*, an opening movement of the stacking surface section 40*s* of the apparatus cover 2*c* pushes the stacking surface section 51*s* of the sub cover 51 upwardly, to open the sub cover 51 along with the apparatus cover 2*c*. On the other hand, upon closing the apparatus cover 2*c*, the bias force of the torsion spring 53 closes the sub cover 51 along with the closing movement of the apparatus cover 2*c*. Accordingly, the sub cover 51 is opened or closed together with the opening or closing movement of the apparatus cover 2*c*.

An overlap amount of the sub cover 51 to the stacking surface section 40*s* and an position of the rotational shaft 52 of the sub cover 51 are set such that a rotational trajectory Tr2 of the front end of the stacking surface section 51*s* of the sub cover 51 is positioned inside (front side) with respect to the rotational trajectory Tr3 of the stacking surface section 40*s* of the apparatus cover 2*c*. With this, the sub cover 51 is able to be surely opened or closed together with the apparatus cover 2*c* without the stacking surface section 51*s* being disengaged with the stacking surface section 40*s* of the apparatus cover 2*c*.

[3. Removing Operation of the Fixation Unit and Opening Operation of the Apparatus Cover]

Next, operation of removing the fixation unit 8 and operation of opening the apparatus cover 2*c* are explained. First, the operation of removing the fixation unit 8 is explained. The operation of removing the fixation unit 8 is an operation of taking out the fixation unit 8 from the image formation apparatus 1, for example, when the fixation unit 8 is to be replaced due to a life of the fixation unit 8, a paper jam in the fixation unit 8, or the like. Specifically, when a user needs to take out the fixation unit 8, the user grabs the handles 9 exposed through the opening 7 of the apparatus cover 2*c* and pulls the handles 9 obliquely upward in the front direction while leaving the apparatus cover 2*c* closed as illustrated in FIG. 4. With this, the fixation unit 8 attached to the housing main body 2*m* is taken out from the inside of the housing main body 2*m* through the opening 7 of the apparatus cover 2*c*.

On the other hand, the operation of attaching the fixation unit 8 to the housing main body 2*m* is a reverse operation with respect to the removing operation. That is, when a user needs to attach the fixation unit 8 to the housing main body 2*m*, the user grabs the fixation unit 8 and pushes the fixation unit 8 down through the opening 7 of the apparatus cover 2*c* into the housing main body 2*m*, so as to attach the fixation unit 8 to the housing main body 2*m*.

Next, the operation of opening the apparatus cover 2*c* is explained. The operation of opening the apparatus cover 2*c* is an operation of opening the apparatus cover 2*c*, for example, when the conveyance belt 25 is to be replaced, when a paper jam is occurred at a position upstream of the fixation unit 8 in the conveyance path R, or the like. Specifically, when a user needs to open the apparatus cover 2*c*, the user grabs an unillustrated handle(s) provided at the apparatus cover 2*c* and pulls the front portion of the apparatus cover 2*c* upwardly, to open the apparatus cover 2*c* as illustrated in FIG. 3. At this time, the sub cover 51 of the fixation unit 8 is opened together with the apparatus cover 2*c* because the stacking surface section 51*s* of the sub cover 51 provided over and overlapped with the apparatus cover 2*c* is pushed upwardly by the opening movement of the apparatus cover 2*c*, as illustrated in FIG. 6.

On the other hand, the operation of closing the apparatus cover 2*c* is a reverse operation with respect to the opening operation. That is, when a user needs to close the opened apparatus cover 2*c*, the user pushes the front portion of the opened apparatus cover 2*c* downwardly, to close the apparatus cover 2*c*. At this time, the sub cover 51 of the fixation unit 8 is closed together with the apparatus cover 2*c*, by the biasing force of the torsion spring 53.

[4. Effects]

As described above, according to an embodiment, the opening 7 is provided at the rear portion of the stacker 5 formed at the top of the apparatus cover 2*c*, such that the fixation unit 8 detachably accommodated in the housing main body 2*m* to be taken out through the opening 7. With this, while keeping the apparatus cover 2*c* being closed, the fixation unit 8 can be taken out through the opening 7 from the housing 2. Thus, the image formation apparatus 1 can improve efficiency of the operation of removing the fixation unit compared to the related art.

According to an embodiment, in the state where the apparatus cover 2*c* is closed with respect to the housing main body 2*m*, the top surface of the fixation unit 8 exposed through the opening 7 of the apparatus cover 2*c* forms a part (e.g. the rear portion) of the stacker 5. With this, the apparatus housing 2 of the image formation apparatus 1 can be downsized, as compared to, for example, an example in which the stacker 5 and the opening 7 of the apparatus cover 2*c* are separately provided in the apparatus cover 2*c*.

According to an embodiment, the gap Sp1 is provided between the stacking surface section 40*s* of the apparatus cover 2*c* and the stacking surface section 50*s* of the fixation unit 8 (that is, the gap Sp1 is provided at the front end of the opening 7 of the apparatus cover 2*c*), such that the apparatus cover assembly 41 and the fixation unit 8 are not interfered with each other upon opening and closing the apparatus cover 2*c*. In addition to this, the sub cover 51 is attached to the top surface of the fixation unit 8 (that is, to the fixation unit cover 43*m*), wherein the sub cover 51 covers the gap Sp1, forms the rear portion of the stacker 5 together with the top surface of the fixation unit 8, and opens and closes along the opening and closing movements of the apparatus cover 2*c*. With this configuration, the image formation apparatus 1 allows the apparatus cover 2*c* to be smoothly opened or closed in the state where the top surface of the fixation unit 8 is exposed through the opening 7 of the apparatus cover 2*c*, as well as preventing the foreign matter(s) or the like from entering into the apparatus housing 2 through the gap Sp1 between the stacking surface section 40*s* of the apparatus cover 2*c* and the stacking surface section 50*s* of the fixation unit 8 the apparatus housing 2.

According to an embodiment, the top surface of the fixation unit 8 has the dual structure comprising the fixation unit cover 43*m* and the sub cover 51. This configuration can impede the heat generated in the fixation unit 8 from being transferred to the sheet(s) P accumulated in the stacker 5 provided above the fixation unit 8, thereby preventing the sheet(s) stacked in the stacker 5 from being curled due to the heat from the fixation unit 8.

According to an embodiment, the fixation unit 8 is accommodated in the fixation unit accommodation section 42 in such a manner that the fixation unit 8 is tilted with respect to the bottom surface of the apparatus housing 2 toward the front direction, and the handles 9 of the fixation unit 8 is exposed through the opening 7 of the apparatus cover 2*c*. With this configuration, a user can take out the fixation unit 8 from the fixation unit accommodation section 42 through the opening 7 of the apparatus cover 2*c* by pulling the exposed handles 9 obliquely upward in the front direction. Accordingly, this can make it easy to pull out the fixation unit 8 compared to a structure where the fixation unit 8 needs to be pulled out vertically, and can downsize a space for pulling out the fixation unit 8 above the apparatus cover 2*c*.

According to an embodiment, the fixation unit 8 is accommodated in the fixation unit accommodation section 42 with being tilted with respect to the bottom surface of the apparatus housing 2 toward the front direction. This configuration can downsize the gap Sp1 between the stacking surface section 40*s* of the apparatus cover 2*c* and the stacking surface section 50*s* of the fixation unit 8, and thus can downsize the projection amount of the sub cover 51 from the fixation unit housing 43 toward the front direction as much as possible (see FIGS. 7A and 7B).

Figure 7A:
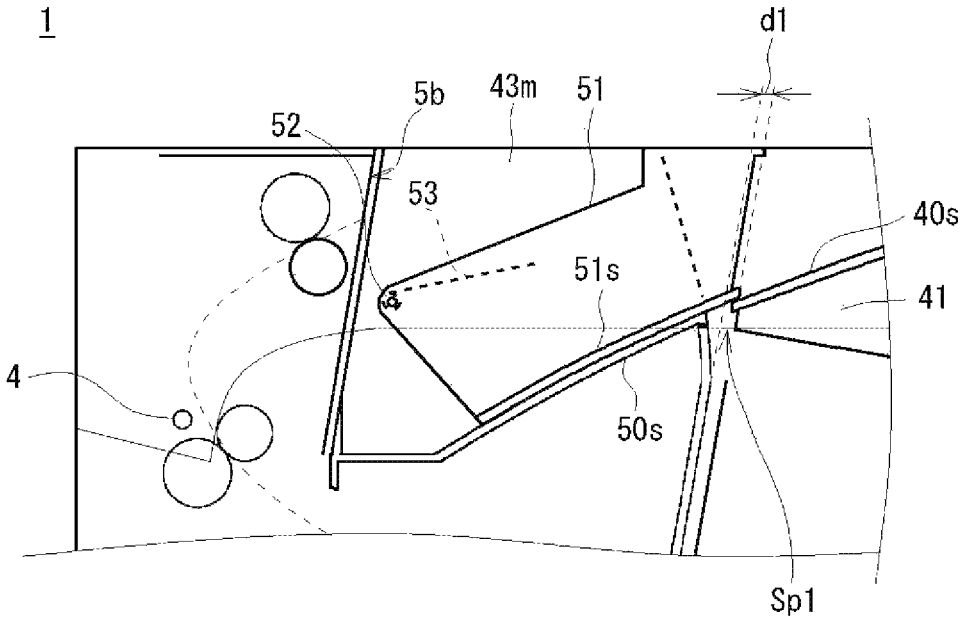
FIGS. 7A and 7B are diagrams illustrating enlarged cross-sectional views illustrating a projected amount of the sub cover in a structure where the fixation unit is accommodated with being forwardly tilted and a projected amount of the sub cover in a structure where the fixation unit is vertically accommodated.
Figure 7B:
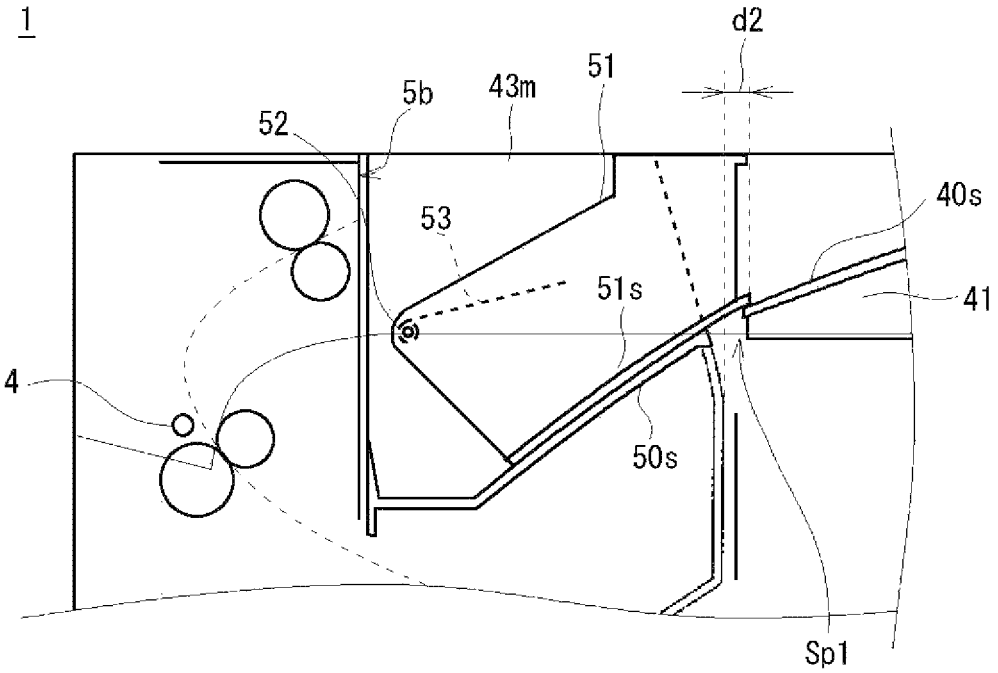

As illustrative examples, FIG. 7A illustrates an projection amount d1 of the sub cover 51 in a case (an embodiment) where the fixation unit 8 is accommodated with being tilted with respect to the bottom surface of the apparatus housing 2 toward the front direction and FIG. 7B illustrates a projection amount d2 of the sub cover 51 in a case (comparison example) where the fixation unit 8 is vertically accommodated with respect to the bottom surface of the apparatus housing 2. Note that in FIGS. 7A and 7B, a part of illustration is omitted for simplifying the explanation. As illustrated in FIGS. 7A and 7B, the gap Sp1 in the embodiment (FIG. 7A) where the fixation unit 8 is accommodated with being tilted with respect to the bottom surface of the apparatus housing 2 toward the front direction can be shorten compared to that in the comparison example (FIG. 7B) where the fixation unit 8 is vertically accommodated with the bottom surface of the apparatus housing 2. This can make the projection amount d1 of the sub cover 51 in the embodiment (FIG. 7A) smaller than the projection amount d2 in the comparison example (FIG. 7B) (d1<d2).

As described above, the image formation apparatus 1 according to an embodiment can minimize the projection amount of the sub cover 51 from the fixation unit housing 43 toward the front direction, and thus can prevent the sub cover 51 from being damaged at the time of transportation of the fixation unit 8 or the like.

[5. Modifications]

[5-1. Modification 1]

In the above described one or more embodiments, a user can take out the fixation unit 8 from the housing main body 2*m* by grabbing the handles 9 provided at the left and right end portions of the top surface of the fixation unit 8 exposed through the opening 7 of the apparatus cover 2*c* to the outside of the housing and pulling the fixation unit 8 in the obliquely upward in the front direction, while keeping the apparatus cover 2 of the image formation apparatus 1 closed.

Figure 8A:
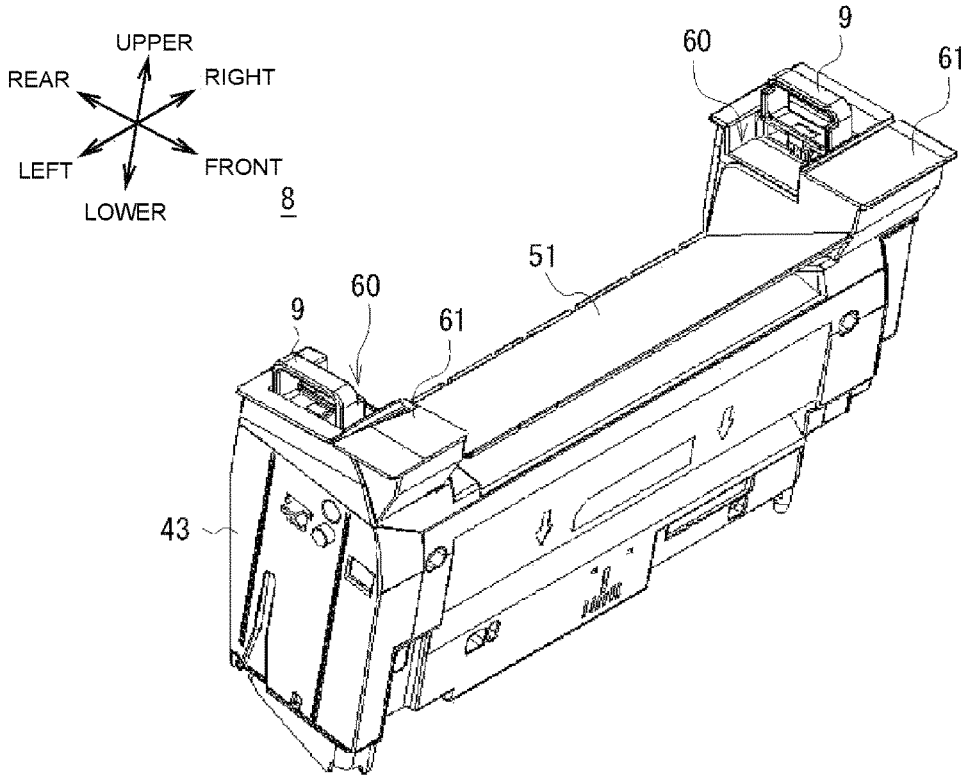
FIGS. 8A and 8B are diagrams illustrating perspective views of the exterior configuration of the fixation unit, FIG. 8A illustrating a state where handles of the fixation unit are projected and FIG. 8B illustrating a state where the handles of the fixation unit are folded.
Figure 8B:
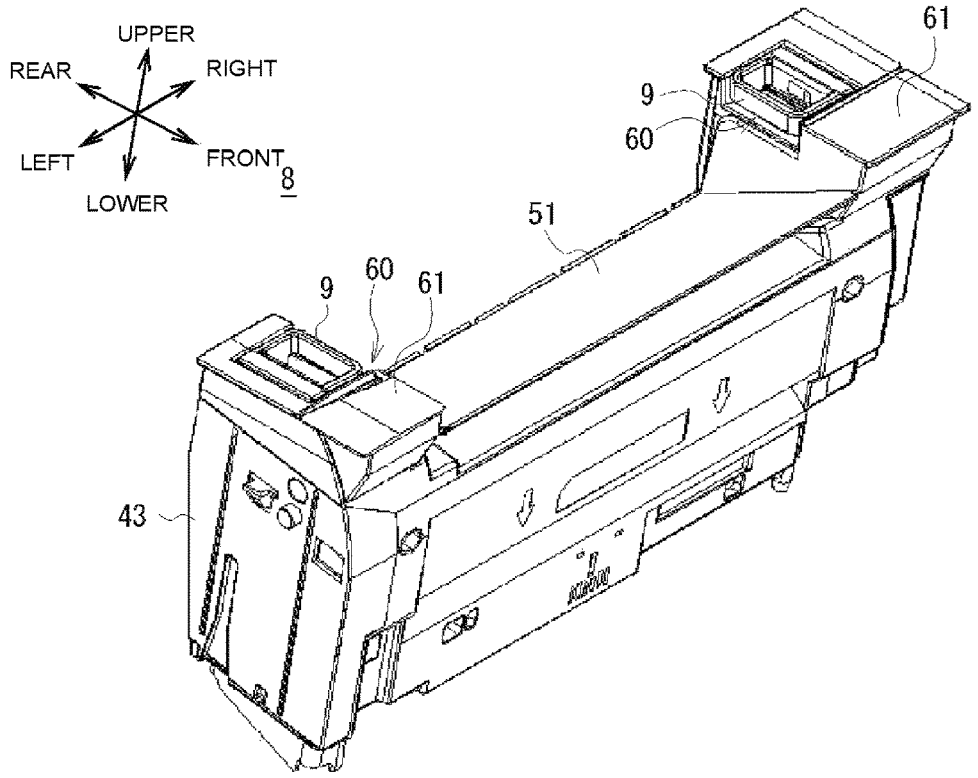

As illustrated in FIGS. 8A and 8B illustrating the exterior of the fixation unit 8, the left and right handles 9 may be attached to the left and right end portions of the top surface of the fixation unit 8 to be rotatable about a handle rotational shaft (not illustrated in FIGS. 8A and 8B) extending in the short-side direction (the front-rear direction) of the top surface of the fixation unit 8.

Figure 9:
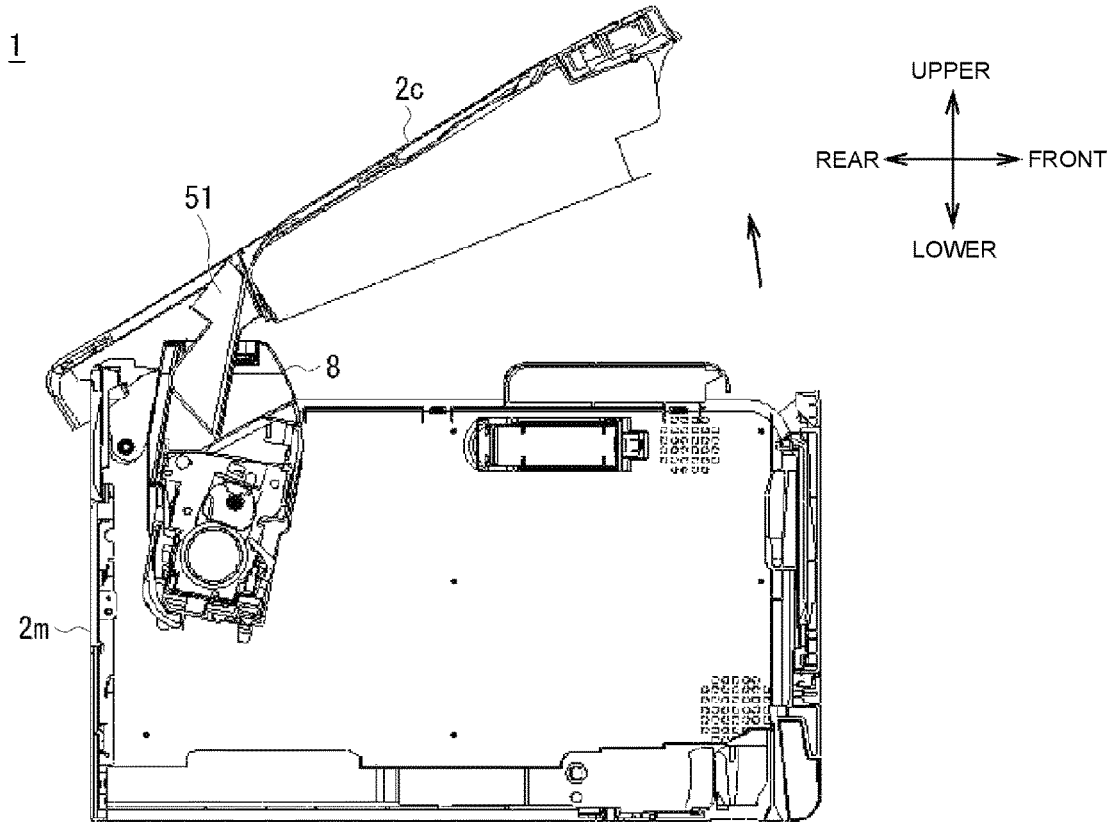
FIG. 9 is a diagram illustrating a cross-sectional view of the image formation unit when the sub cover is opened together with the apparatus cover.

Note that FIG. 8A illustrates a state where the left and right the handles 9 stand upwardly or vertically from the left and right end portion of the top surface of the fixation unit 8 (hereinafter referred to as a projected state), and FIG. 9 illustrates a state where the left handles 9 are folded inwardly or horizontally and accommodated in recess portions 60 provided at the left and right end portions of the top surface of the fixation unit 8 (hereinafter referred to as a folded state). The left and right handles 9 are rotatable from the projected state illustrated in FIG. 8A to the folded state illustrated in FIG. 8B in the left-right direction by the 90 degree angle about the handle rotational shaft, to accommodate or fold the handles 9 in the recess portions 60. The left and right handles 9 also rotatable in a revise direction from the folded state illustrated in FIG. 8B to the projected state illustrated in FIG. 8A by the 90 degree angle about the handle rotational shaft, to stand the handles 9 upwardly.

In the image formation apparatus according the above described one or more embodiments, as illustrated in FIG. 9 which illustrates the cross-sectional view thereof as seen from the left side, the sub cover 51 of the fixation unit 8 is opened along with the opening movement of the apparatus cover 2*c* as described above.

Figure 10A:
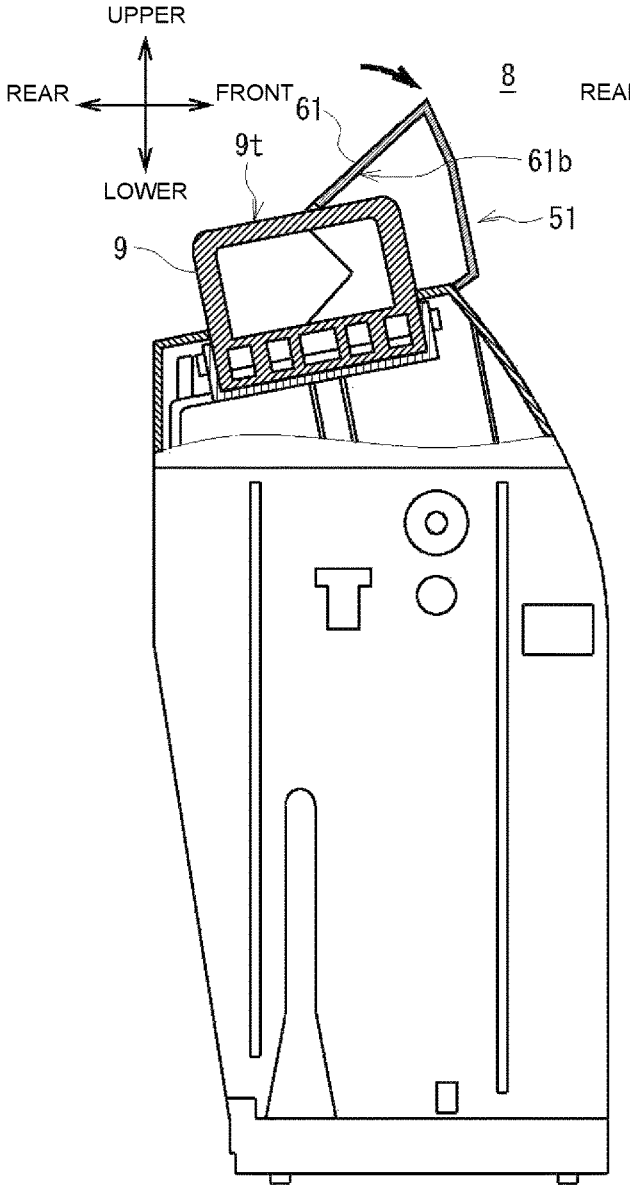
FIG. 10A and FIG. 10B are diagrams illustrating a partial cross-sectional view of examples of the fixation unit when the handle is interfered with the sub cover.
Figure 11:
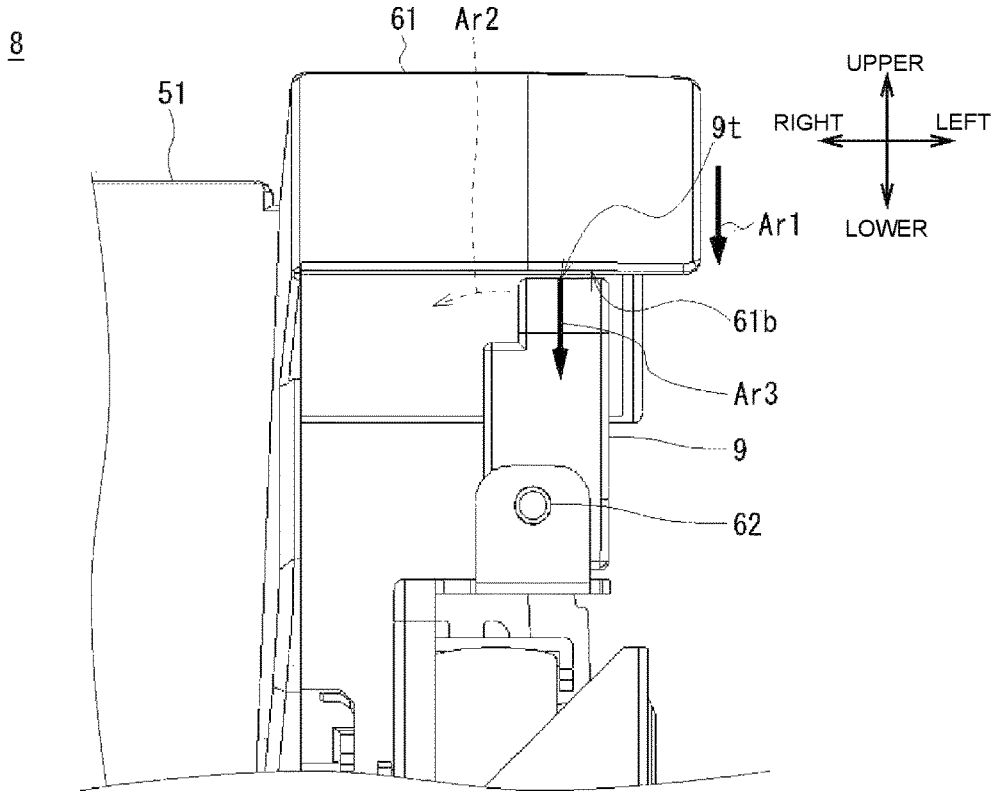
FIG. 11 is a diagram illustrating an enlarged side view of an example in which a bottom surface of the sub cover or a top surface of the handle does not have an inclined surface, for explaining a direction of a force received from the sub cover to the handle upon closing the sub cover.

FIG. 10A is a diagram illustrating a partial cross-sectional side view of the fixation unit 8 as seen from the left side and FIG. 11 is a diagram illustrating an enlarged view of a left end portion of the top surface of the fixation unit 8 as seen from the rear side, both for explaining movements of the components when the sub cover 51 is closed together with the apparatus cover 2*c* in the state where the handles 9 of the fixation unit 8 is projected upwardly. Note that FIG. 11 omits some components or parts for simplify the explanation. As illustrated in FIGS. 10A and 11, when a user tries to close the sub cover 51 in a state where the handle 9 stands upright, a bottom surface 61*b* of the side end portion 61 (left and right side end portions 61) of the sub cover 51 (hereinafter referred to as end portion bottom surface) comes in contact with the top surface 9*t* of the handle 9, because the upper portion of the handle 9 are provided within the rotational trajectory of the side end portion 61 of the sub cover 51. In short, upon closing the sub cover 51, the sub cover 51 as an interference member comes in contact with the upper portion of the projected handle 9.

In this instance, as illustrated in FIG. 11, the movement direction of the sub cover 51 indicated the arrow Ar1 (downward direction) is orthogonal to the rotational direction of the handle 9 indicated the arrow Ar2 (right direction), as seen from an axial end of the handle rotational shaft 62 (that is, as seen from the rear side). Therefore, in the structure illustrated in FIG. 11 in which the top surface 9*t* of the projected handle 9 and the end portion bottom surface 61*b* of the sub cover 51 is orthogonal to the movement direction (downward direction) of the sub cover 51 indicated in the arrow Ar1, the top surface 9*t* of the handle 9 is pushed by the end portion bottom surface 61*b* of the sub cover 51 toward a direction same as the movement direction of the sub cover 51 indicated by the arrow Ar3 (downward direction).

Accordingly, the direction of the force received by the top surface 9*t* of the handle 9 from the end portion bottom surface 61*b* of the sub cover 51 indicated by the arrow Ar3 (downward direction) is orthogonal to the rotational direction of the handle 9 indicated by the arrow Ar2 (right direction). That is, the force received by the top surface 9*t* of the handle 9 does not contain a component in the rotational direction of the handle 9, and thus the handle 9 does not rotate by the force received by the top surface 9*t* of the handle 9 indicated by the arrow Ar3. Note that the explanation has been made for the left handle 9. However, the right handle is the same as or symmetrical to the left handle, and thus the explanation therefore is omitted.

Accordingly, in the example illustrated in FIG. 11, the sub cover 51 gets caught on the handle 9, thus the apparatus cover 2*c* cannot be closed smoothly.

Figure 12:
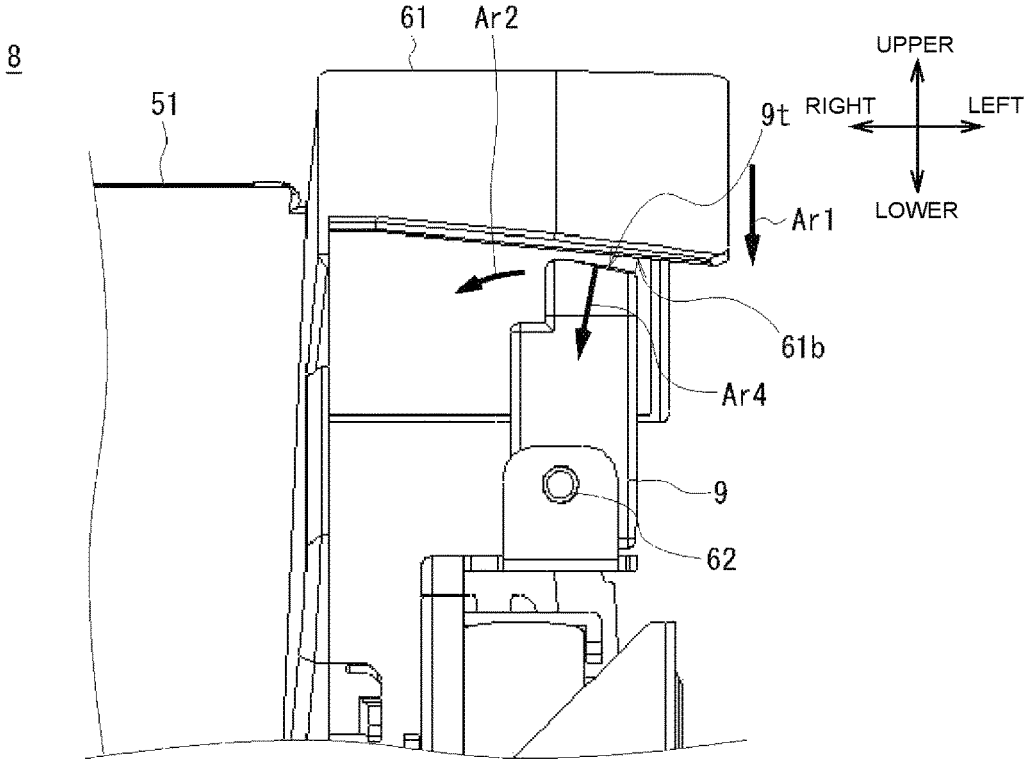
FIG. 12 is a diagram illustrating an enlarged side view of a modified example in which a bottom surface of the sub cover and a top surface of the handle have inclined surfaces, for explaining a direction of a force received from the sub cover to the handle upon closing the sub cover.

In light of this, as illustrated in a modification in FIG. 12, the top surface 9*t* of the handle 9 and the end portion bottom surface 61*b* of the sub cover 51 may include inclined surfaces, respectively. Specifically, in the modification illustrated in FIG. 12, the top surface 9*t* of the handle 9 is inclined toward a direction opposite to the direction in which the handle 9 rotates from the projected state to the folded state (that is, the rotational direction of the projected handle 9 indicated by the arrow Ar2), and also the end portion bottom surface 61*b* of the sub cover 51 is inclined toward the direction opposite to the rotational direction of the projected handle 9 indicated by the arrow Ar2.

More specifically, in the modification illustrated in FIG. 12, the top surface 9*t* of the handle 9 is inclined such that the top surface 9*t* of the handle 9 gets closer to the lower end of the handle 9 as going toward the direction (left) opposite to the rotational direction (right) of the projected handle 9. Likewise, the end portion bottom surface 61*b* of the sub cover 51 is inclined such that the end portion bottom surface 61*b* of the sub cover 51 gets closer to the lower end of the handle 9 as going toward the direction (left) opposite to the rotational direction (right) of the projected handle 9.

With this configuration, the force received to the top surface 9*t* of the handle 9 is converted from the direction indicated by the arrow Ar1 (downward direction) to the direction indicated by the arrow Ar4 in FIG. 12 (obliquely downward right), which is inclined toward the rotational direction of the handles 9 (right direction). Thus, the force (arrow Ar4) received by the top surface 9*t* of the handle 9 contains a component in the rotational direction of the handle 8 (right direction component), and thus rotates the handle 9 from the projected position to the folded position. The above explanation is made for the left handle 9. However, the right handle is the same as or symmetrical to the left handle, and thus the explanation therefor is omitted.

Accordingly, in the modification illustrated in FIG. 12, when a user applies a force to the apparatus cover 2*c* to close the apparatus cover 2*c* in the state where the bottom surface 61*b* of the side end portion of the sub cover 51 is in contact with the top surface 9*t* of the projected handles 9, the handle 9 is pushed to be rotated by the sub cover 51 closing together with the apparatus cover 2*c*, to transit from the projected state to the folded state.

As described above, in the modification illustrated in FIG. 12, both a contact portion of the handle 9 to the sub cover 51 (which is, the upper surface 9*t* of the handle 8) and a contact portion of the sub cover 51 to the handle 9 (which is, the end portion bottom surface 61*b* of the sub cover 51) are inclined. Therefore, even if a user tries to close the apparatus cover 2*c* in the state where the handles 9 is in the projected state, the projected handle 9 is pushed by the sub cover 51 closing together with the apparatus cover 2*c*, to be rotated from the projected state to the folded state, so as to prevent damages of the handle 9 and the sub cover 51.

In the above describe modification illustrated in FIG. 12, the top surface 9*t* of the handle 9 includes the inclined surface and the end portion bottom surface 61*b* of the sub cover 51 includes the inclined surface. However, an embodiment or a modification is not limited to this. For example, among the top surface 9*t* of the handle 9 and the end portion bottom surface 61*b* of the sub cover 51, only the top surface 9*t* of the handle 9 may include the inclined surface as shown in a modification illustrated in FIG. 13A, or only the end portion bottom surface 61*b* of the sub cover 51 may include the inclined surface as shown in a modification illustrated in FIG. 13B.

Figure 13A:
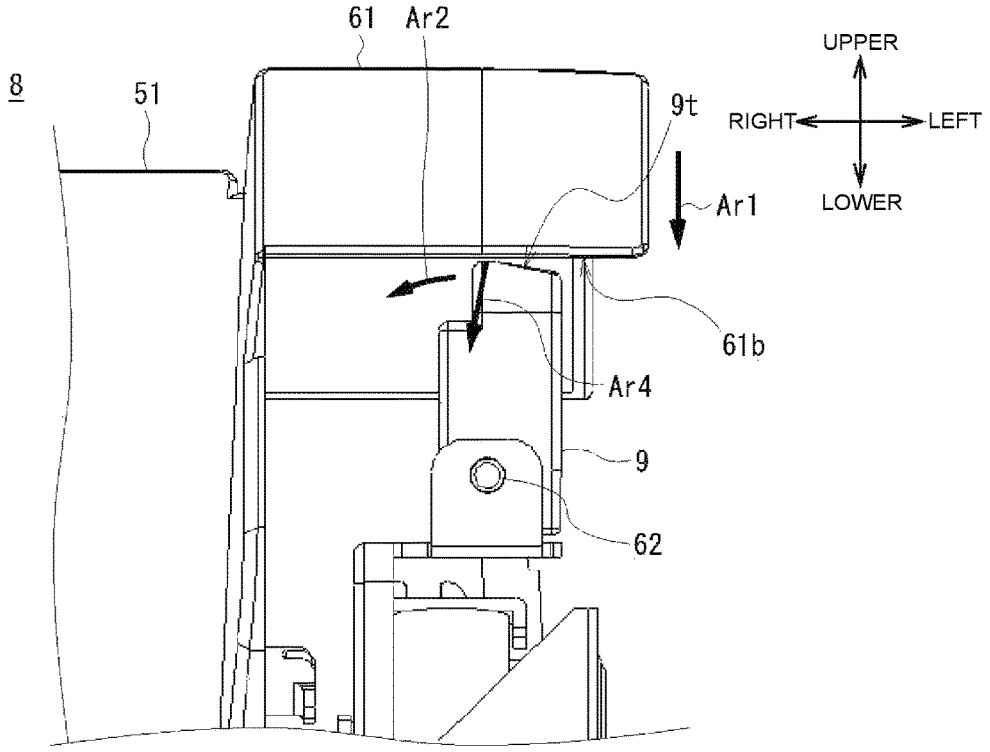
FIGS. 13A and 13B are diagrams illustrating enlarged side views of modified examples in which one of a bottom surface of the sub cover and a top surface of the handle has an inclined surface, for explaining a direction of a force received from the sub cover to the handle upon closing the sub cover.
Figure 13B:
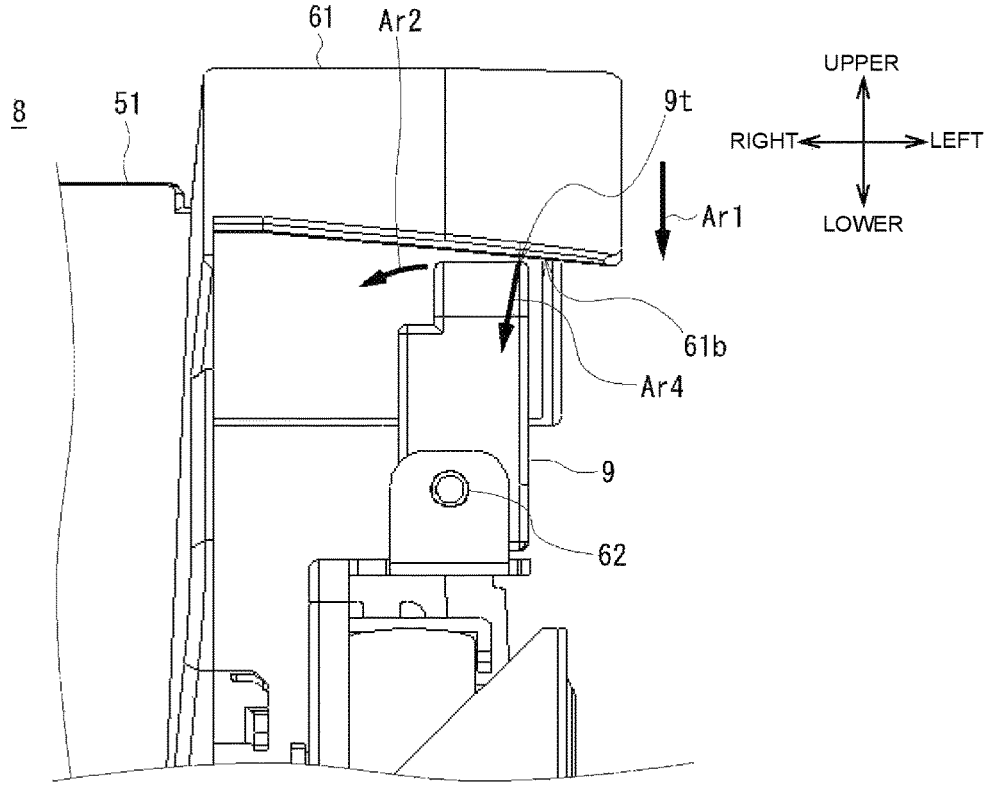

In both of the modifications illustrated in FIGS. 13A and 13B, the force received by the top surfaces 9*t* of the handles 9 from the end portion bottom surface 61*b* of the sub cover 51 is in a direction indicated in the arrow Ar4 (diagonally downward right). Accordingly, the handle 9 is pushed by the sub cover 51 to be rotated. That is, even in a case where only one of the top surface 9*t* of the handle 9 and the end portion bottom surface 61*b* of the sub cover 51 includes the inclined surface, the handle 9 in the projected position is pushed by the sub cover 51 which is closed together with the apparatus cover 2*c*, so as to be rotated from the projected state to the folded state, thereby preventing damages of the handle 9 and the sub cover 51.

Figure 10B:
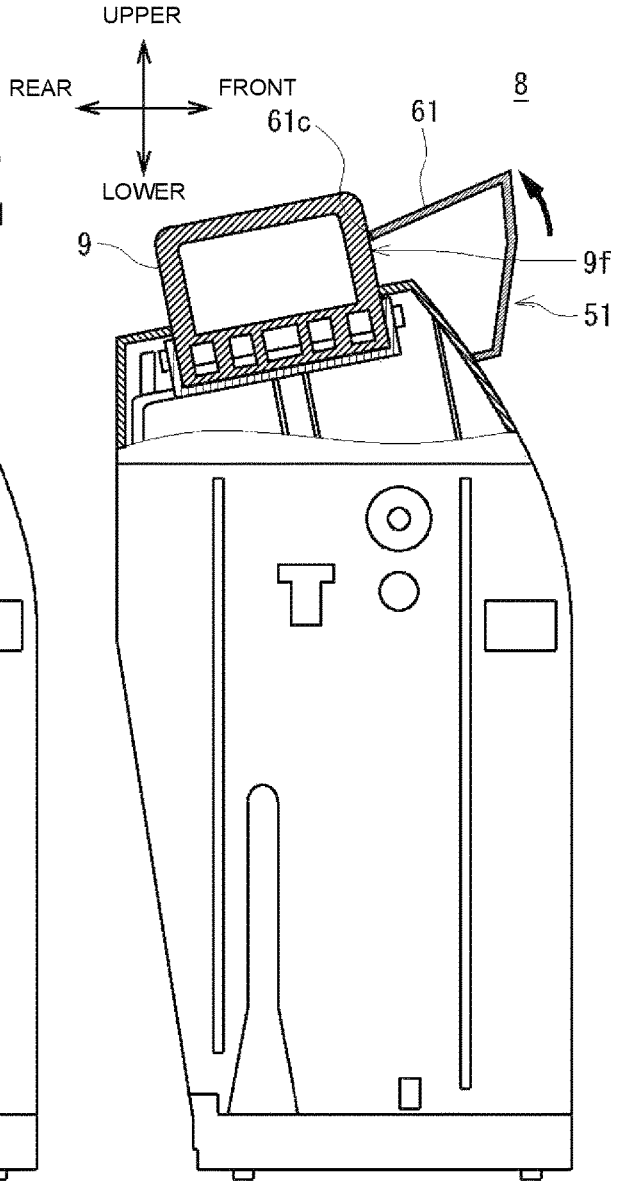
Figure 14:
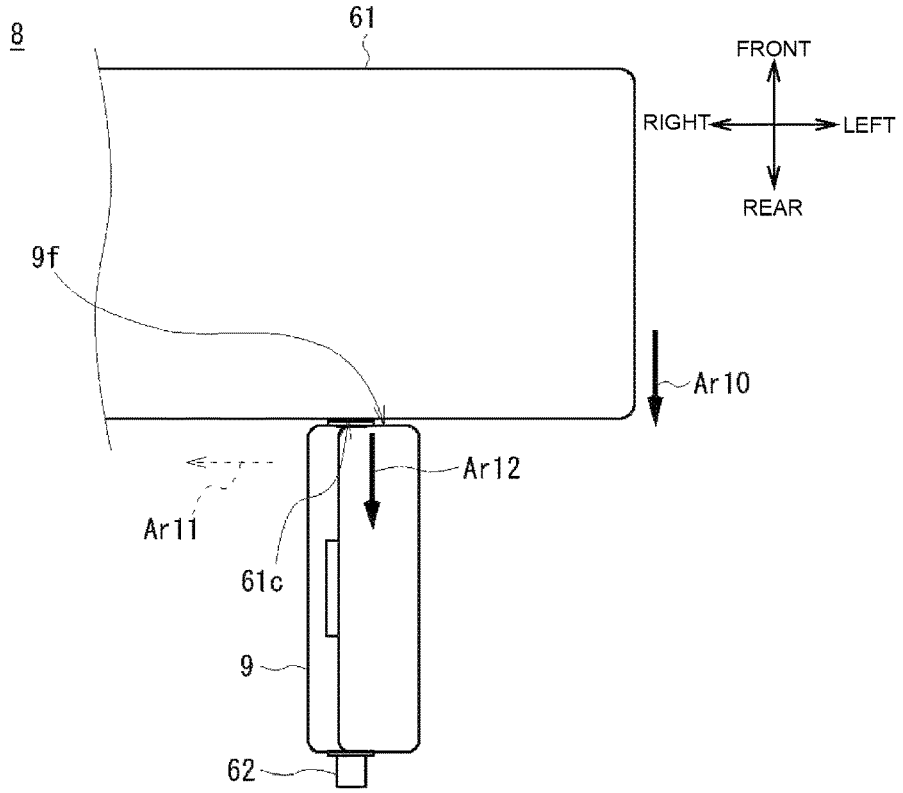
FIG. 14 is a diagram illustrating an enlarged top view of an example in which a rear surface of the sub cover or a front surface of the handle does not have an inclined surface, for explaining a direction of a force received from the sub cover to the handle upon closing the sub cover.

FIG. 10B is a diagram illustrating a partial cross-sectional side view of the fixation unit 8 as seen from the left side and FIG. 14 is a diagram illustrating an enlarged top view of a left top portion of the fixation unit 8, both for explaining movements of the components when the sub cover 51 is being opened together with the apparatus cover 2*c* from a state where the sub cover 51 of the fixation unit 8 is closed and the handle 9 of the fixation unit 8 is projected. Note that FIG. 14 illustrates only the left end portion 61 of the sub cover 51 and the left handle 9, out of the entire of the fixation unit 8. As illustrated in FIGS. 10B and 14, when the sub cover 51 is opened in the state where the handle 9 is projected, the rear surface 61*c* of the side end portions 61 of the sub cover 51 (hereinafter referred to as side end portion rear surface) hits the front surfaces 9*f* of the handles 9 from the front side, because the front side portion of the projected handles 9 is in the rotational trajectory of the side end portion 61 of the sub cover 51. That is, upon opening the sub cover 51, the sub cover 51 as an interference member comes in contact with the side surface of the projected handle 9 to interfere with the projected handle 9, according to the example illustrated in FIGS. 10B and 14.

As illustrated in FIG. 14, as seen from the upper side, the movement direction of the sub cover 51 indicated by the arrow Ar10 (rear direction) and the rotational direction of the handles 9 indicated by the arrow Ar11 (right direction) are orthogonal to each other. Accordingly, if both the front surface 9*f* of the projected handle 9 and the side end portion rear surface 61*c* of the sub cover 51 are orthogonal to the movement direction of the sub cover (the rear direction) indicated by the arrow Ar10 as illustrated in FIG. 14, the front surface 9*f* of the projected handle 9 receives a force from the side end portion rear surface 61*c* of the sub cover 51 in the direction same as the movement direction of the sub cover 51 indicated by the arrow Ar12 (the rear direction).

In this structure illustrated in FIG. 14, the direction (rear direction) of the force (indicated by the arrow Ar12) received by the front surface 9*f* of the handle 9 from the side end portion rear surface 61*c* of the sub cover 51 is orthogonal to the rotational direction of the handle 9 indicated by the arrow Ar11 (right direction). Thus, because the force received by the front surface 9*f* of the handle 9 does not contain a component in the rotational direction of the handle 9, the force to push the front surface 9*f* of the handle 9 indicated by the arrow Ar12 cannot rotate the handle 9. Note that the above description is made for only the left handle 9 but the right handle 9 is the same as or symmetrical to the left handle 9 and thus the explanation therefor is omitted.

Accordingly, the sub cover 51 gets caught on the handle 9, thus the apparatus cover 2*c* cannot be opened smoothly.

Figure 15:
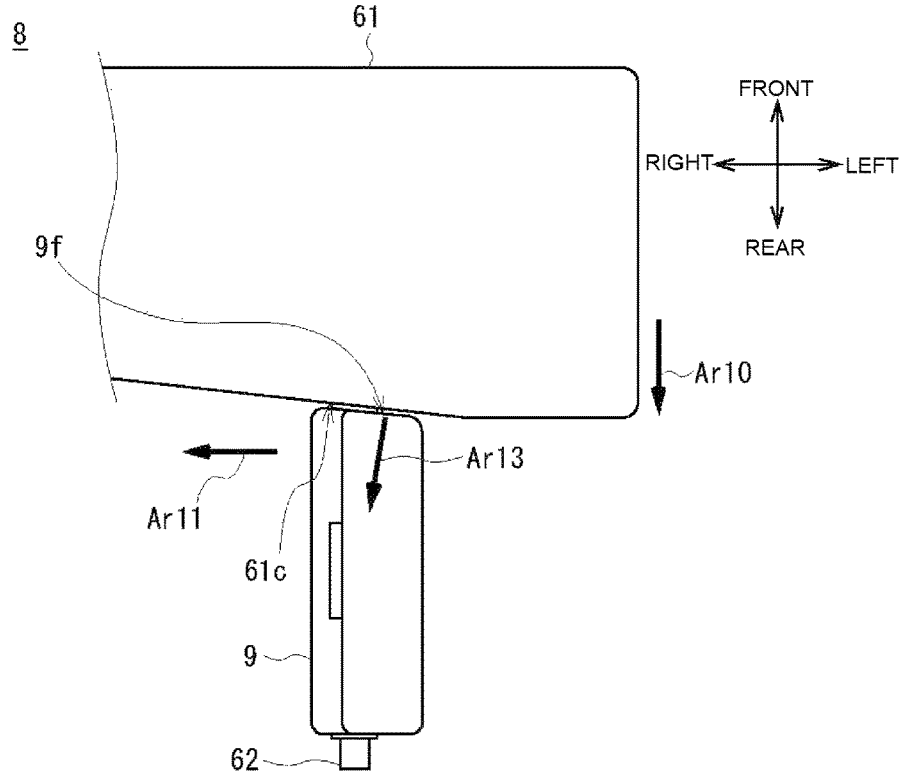
FIG. 15 is a diagram illustrating an enlarged top view of an example in which a rear surface of the sub cover and a front surface of the handle have inclined surfaces, for explaining a direction of a force received from the sub cover to the handle upon closing the sub cover.

In light of this, the front surface 9*f* of the handle 9 and the side end portion rear surface 61*c* of the sub cover 51 may include inclined surfaces, respectively, as shown in a modification in FIG. 15. Specifically, in the modification in FIG. 15, the front surface 9*f* of the handle 9 is inclined toward a direction opposite to the direction in which the handle 9 rotates from the projected state to the folded state (indicated by the arrow Ar11, and the side end portion rear surface 61*c* of the sub cover 51 is inclined toward the direction opposite to the direction in which the handle 9 rotates from the projected state to the folded state.

More specifically, the front surface 9*f* of the handle 9 is inclined such that the front surface 9*f* gets closer to the rear end of the handle as going toward the direction (left side) opposite to the rotational direction (right side) of the handle 9 from the projected state to the folded state. The side end portion rear surface 61*c* of the sub cover 51 is also inclined such that the side end portion rear surface 61*c* gets closer to the rear end of the handle 9 as going to the direction (left side) opposite to the rotational direction (right side) of the handle 9 from the projected state to the folded state.

With this configuration, the force received by the front surface 9*f* of the handle 9 is oriented to a direction (the arrow Ar13 in FIG. 15) inclined toward the rotational direction (the arrow Ar11) of the handle 9. Because the force received by the front surface 9*f* of the handle 9 includes a component in the rotational direction of the handle 9 (right direction component), the handle 9 rotates from the projected state to the folded state by the front surface 9*f* of the handle 9 being pushed in the direction indicated by the arrow Ar13 in response to the opening movement of the sub cover 51. Note that the above description is made for only the left handle 9 but the right handle 9 is the same as or symmetrical to the left handle 9 and thus the explanation therefor is omitted.

Accordingly, if a user tries to further open the apparatus cover 2*c* in the state where the side end portion rear surface

61*c* of the sub cover 51 is in contact with the front surface 9*f* of the projected handle 9, the handle 9 rotates by being pushed by the sub cover 51 to transit from the projected state to the folded state.

As described above, in the modification illustrated in FIG. 15, contact portions of the handle 9 to the sub cover 51 (the front surface 9*f* of the handle 9) and contact portions of the sub cover 51 to the handle 8 (the side end portion rear surface 61*c*) are inclined. Therefore, even if a user tries to open the apparatus cover 2*c* with the handle 9 being in the projected state, the projected handle 9 is pushed by the sub cover 51 opening together with the apparatus cover 2*c*, so as to be rotated from the projected state to the folded state. This may prevent damages of the handle 9 and the sub cover 51.

In the modification illustrated in FIG. 15, both of the front surface 9*f* of the handle 9 and the side end portion rear surface 61*c* of the sub cover 51 have the inclined surfaces respectively. However, an embodiment or a modification is not limited to this. For example, only one of the front surface 9*f* of the handle 9 and the side end portion rear surface 61*c* of the sub cover 51 may have the inclined surface.

In these cases, the force received by the front surface 9*f* of the handle 9 from the side end portion rear surface 61*c* of the sub cover 51 is also oriented in the direction indicated by the arrow Ar13 in FIG. 15 (diagonally backward right). Thus, the projected handle 9 is pushed by the sub cover 51 opening together with the apparatus cover 2*c*, so as to be rotated from the projected state to the folded state, to prevent damages of the handle 9 and the sub cover 51.

In the above described modifications, the sub cover 51 comes in contact with the projected handle 9, to be interfered with the projected handle 9. However, an embodiment or a modification is not limited to this. For example, the sub cover 51 may be omitted from the fixation unit 8 or the like, and the apparatus cover 2*c* may come in contact with the projected handle 9 to be interfered with the projected handle 9. In other word, an interference member to be interfered with the projected handle 9 may be the apparatus cover 2*c* instead of the sub cover 51.

In this case, similar to the structure in which the sub cover 51 is interfered with the projected handle, at least one of a contact portion of the handle 9 to the apparatus cover 2*c* and a contact portion of the apparatus cover 2*c* to the handle 9 may have the inclined surface. Further, the image formation apparatus may have an interference member, other than the sub cover 51, which is interfered with the projected handle 9, and in this case, at least one of a contact portion of the handle 9 to the interference member and a contact portion of the interference member to the handle 9 may have the inclined surface, similar to the structure in which the sub cover 51 is interfered with the projected handle.

[5-2. Modification 2]

In the above describe one or more embodiments, the stacking surface section 51*s* of the sub cover 51 is overlapped with the stacking surface section 40*s* of the apparatus cover 2*c* from above. However, an embodiment or a modification is not limited to this. For example, in addition to the stacking surface section 51*s* of the sub cover 51 being overlapped with the stacking surface section 40*s* of the apparatus cover 2*c* from above, the left and right side wall sections 51*s* of the sub cover 51 may be overlapped with the left and right side wall section 40*w* of the apparatus cover 2*c* from the inner side of the left-right direction. Also the left and right end portions provided at the outside of the left and right side wall section 50*w* of the sub cover 51 in the left-right direction may be overlapped with the left and right end portions provided at the outside of the left and right side wall section 40*w* of the apparatus cover 2*c* from above.

[5-3. Modification 3]

In the above describe one or more embodiments, the components or parts other than the sheet tray 27 in the image formation apparatus 1 are provided to be inclined with respect to the bottom surface of the apparatus housing 2. However, an embodiment or a modification is not limited to this. For example, the components or parts other than the sheet tray 27 in the image formation apparatus 1 may be provided parallel to the bottom surface of the apparatus housing 2. In this configuration, the fixation unit accommodation section 42 may be provided such that the fixation unit housing 43 is accommodated orthogonal to the bottom surface of the apparatus housing 2 so that the fixation unit housing 43 can be pulled out upwardly in the vertical direction.

[5-4. Modification 4]

In the above describe one or more embodiments, the apparatus cover assembly 41 includes the LED heads 21 of the image formation units 20. However, an embodiment or a modification is not limited to this. For example, the apparatus cover assembly 41 may include not only the LED heads 21 but also the image formation units 20. In this configuration, the fixation unit housing 43 may be provided outside of the rotational trajectory of the apparatus cover assembly 41 (that is, outside of the rotational trajectory of the image formation unit 20C provided closest to the fixation unit 8) so that the image formation unit 20C does not interfere with the fixation unit housing 43 upon opening and closing of the apparatus cover 2*c*.

[5-5. Modification 5]

In the above describe one or more embodiments, the gap Sp1 is provided between the stacking surface section 40*s* of the apparatus cover 2*c* and the stacking surface section 50*s* of the fixation unit 8 to prevent the interference between the apparatus cover assembly 41 and the fixation unit 8 upon opening and closing of the apparatus cover 2*c*, and the gap Sp1 is covered with the sub cover 51. However, an embodiment or a modification is not limited to this. For example, in a case where the fixation unit 8 is provided away from the apparatus cover assembly 41 provided on the apparatus cover 2*c* and the fixation unit 8, the interference between the apparatus cover assembly 41 and the fixation unit 8 upon opening and closing of the apparatus cover 2*c* does not need to be considered. Therefore, the gap Sp1 may be minimized as much as possible to omit the sub cover 51 from the fixation unit 8.

[5-6. Modification 6]

In the above describe one or more embodiments, the apparatus cover 2*c* is provided at the top of the apparatus housing 2 to open and close the housing 2. However, an embodiment or a modification is not limited to this. For example, in addition to the apparatus cover 2*c* provided at the top of the apparatus housing 2, the apparatus housing 2 may have another apparatus cover (not illustrated) at the front of the apparatus housing 2, to open and close the apparatus housing. Further, without providing the apparatus cover 2*c* provided at the top of the apparatus housing 2, the apparatus housing 2 may have only an apparatus cover (not illustrated) at the front surface 2*f* of the apparatus housing 2. In the case where an apparatus cover is provided only at the front surface 2*f* of the apparatus housing 2, the top surface of the apparatus housing 2, which is a part of the periphery of the apparatus housing 2, may be provided with the stacker 5 and an opening corresponding to the apparatus cover opening 7, through which the top of the fixation unit 8 may be exposed. In this configuration, there is no need to consider an interference between the fixation unit 8 and an apparatus cover assembly of the apparatus cover provided at the front surface 2*f* of the apparatus housing 2. Thus, the sub cover 51 may be omitted from the fixation unit 8, and in this configuration, as substitute for the sub cover 51, the stacking surface section 50*s* of the fixation unit cover 43*m* may be overlapped with the stacking surface section 40*s* of the apparatus cover 2*c* from above.

In the above describe one or more embodiments, the apparatus cover 2*c* opens and closes substantially the entire of the top surface of the apparatus housing 2. However, an embodiment or a modification is not limited to this. For example, the apparatus cover 2*c* may open or close an opening provided only at the front portion of the top surface of the apparatus housing 2. In this configuration, the rear portion of the top surface of the apparatus housing 2 (that is, a portion of the top surface not overlapped with the modified apparatus cover) may be formed with an opening like the apparatus cover opening 7, through which the top surface of the fixation unit 8 may be exposed. In this configuration, there is no need to consider an interference between the fixation unit 8 and an apparatus cover assembly, and thus the sub cover 51 may be omitted from the fixation unit 8.

[5-7. Modification 7]

In the above describe one or more embodiments, the top surface of the apparatus cover 2*c* is formed with the opening 7 which exposes the top surface of the fixation unit 8 therethrough including the rear portion of the stacker 5 and the portions left and right side thereof. The size and/or the position of the opening 7 may be determined based on the size and/or the position of the top surface of the fixation unit 8. Therefore, in the case where the size and/or the position of the opening 7 is different from those of the above described one or more embodiments, the size and/or the position of the opening 7 may be modified accordingly.

[5-8. Modification 8]

The above describe one or more embodiments are applied to the image formation apparatus 1 as an electrophotographic printer. However, an embodiment or a modification is not limited to this and may be applied to another type of an electrophotographic image formation apparatus different from the image formation apparatus 1. For example, an embodiment or a modification may be applied to an image formation apparatus in which a toner image(s) formed by an image formation unit(s) is transferred to an intermediate transfer belt, and then the toner image(s) are transferred from the intermediate transfer belt to a medium. Further, an embodiment or a modification may be applied to a single-color image formation apparatus having a single image formation unit or may be applied to a color image formation apparatus having more than four image formation units. An embodiment or a modification may also be applied to an image formation apparatus to form an image on a medium other than paper sheets. An embodiment or a modification may also be applied to an image formation apparatus such as an electrophotographic copy machine, facsimile machine, MFP, or the like.

[5-9. Modification 9]

The above described one or more embodiments is provided with the image formation units 20 as an example of an image formation part configured to form an image on a medium. However, an embodiment or a modification is not limited to this. For example, an embodiment or a modification may be applied to an image formation apparatus including an image formation part having a different configuration from the image formation unit(s) 20. Further, the above described one or more embodiments is provided with the torsion spring 53 as an example of a biasing member to bias the sub cover 51 of the fixation unit 8. However, an embodiment or a modification is not limited to this and may be formed with a bias member different from the torsion spring 53.

[5-10. Modification 10]

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

This disclosure is broadly applicable to image formation apparatuses including printers, facsimile machines, multi-function printers, and the like.

The invention claimed is:

1. An image formation apparatus comprising:

an apparatus housing including a stacker formed on a periphery of the apparatus housing, wherein the stacker includes an opening;

an image formation part provided in the apparatus housing and configured to form an image on a medium; and a fixation unit detachably attached in the apparatus housing and configured to fix the image formed by the image formation part on the medium, wherein in a state where the fixation unit is attached in the apparatus housing, a part of the fixation unit is exposed through the opening of the stacker to constitute a part of the stacker such that the opening of the stacker allows the fixation unit to be taken out from the apparatus housing therethrough.

2. The image formation apparatus according to claim 1, wherein the apparatus housing includes a housing main body and an apparatus cover to open and close the housing main body, the apparatus cover including the stacker on a periphery of the apparatus cover, the fixation unit is detachably attached to the housing main body and is allowed to be taken out from the housing main body through the opening provided at the stacker of the apparatus cover, and in the state where the fixation unit is attached to the housing main body and the apparatus cover is closed, the part of the fixation unit is exposed through the opening provided at the stacker of the apparatus cover and constitutes the part of the stacker.

3. The image formation apparatus according to claim 2, wherein the fixation unit is formed with, at the part of the fixation unit that is exposed through the opening, a stacking surface section that forms a part of a stacking surface of the stacker, the apparatus cover is formed with, on the periphery of the apparatus cover, a stacking surface section that forms a part of the stacking surface of the stacker, and in the state where the fixation unit is attached to the housing main body and the apparatus cover is closed, the stacking surface section of the fixation unit and the stacking surface section of the apparatus cover form the stacking surface of the stacker.

4. The image formation apparatus according to claim 3, further comprising a sub cover provided at the exposed part of the fixation unit and configured to open and close along with opening and closing of the apparatus cover, the sub cover covering a gap between the stacking surface section of the fixation unit and the stacking surface section of the apparatus cover.

5. The image formation apparatus according to claim 4, wherein the sub cover is rotatable to open and close about a rotational axis provided at opposite side of the exposed part of the fixation unit from the gap.

6. The image formation apparatus according to claim 4, wherein the sub cover is formed with a stacking surface section overlapping with both a part of the stacking surface section of the fixation unit and a part of the stacking surface section of the apparatus cover and covering the gap, and the stacking surface section of the fixation unit, the stacking surface section of the apparatus cover, and the stacking surface section of the sub cover form the stacking surface of the stacker, in the state where the fixation unit is attached to the housing main body and the sub cover and the apparatus cover are closed.

7. The image formation apparatus according to claim 6, wherein upon opening the apparatus cover, the stacking surface section of the apparatus cover pushes up the stacking surface section of the sub cover to open the sub cover.

8. The image formation apparatus according to claim 7, further comprising a biasing member that biases the sub cover toward a closing direction of the sub cover, such that the sub cover is closed by means of a biasing force of the biasing member when the apparatus cover is closed.

9. The image formation apparatus according to claim 4, wherein the exposed part of the fixation unit comprises a fixation unit cover, and the sub cover is attached to be overlapped with a part of the fixation unit cover.

10. The image formation apparatus according to claim 1, wherein the fixation unit is attached to the apparatus housing such that the fixation unit is inclined with respect to a bottom surface of the apparatus housing toward a front direction of the apparatus housing.

11. The image formation apparatus according to claim 1, further comprising a handle provided at the exposed part of the fixation unit and movable between a projected state in which the handle is projected from the exposed part and a folded state in which the handle is folded in the exposed part; and an interference member configured to be interfered with the handle in the projected state, wherein at least one of a contact portion of the handle to the interference member and a contact portion of the interference member to the handle is inclined toward a direction opposite to a direction in which the handle moves from the projected state to the folded state.

12. The image formation apparatus according to claim 11, wherein the apparatus housing includes a housing main body and an apparatus cover to open and close the housing main body, the apparatus cover including the stacker on a periphery of the apparatus cover, the fixation unit is detachably attached to the housing main body and is allowed to be taken out from the housing main body through the opening provided at the stacker of the apparatus cover, and the interference member is a member to open and close along with the opening and closing movement of the apparatus cover, and comes in contact with the handle upon opening or closing of the interference member.

13. The image formation apparatus according to claim 12, wherein the interference member comes in contact with an upper portion of the handle in the projected state upon opening or closing of the interference member, and the upper portion of the projected handle includes an inclined surface which urges the handle to move from the projected state to the folded state.

14. The image formation apparatus according to claim 12, wherein the interference member comes in contact with a side potion of the handle in the projected state upon opening or closing of the interference member, and the side portion of the projected handle includes an inclined surface which urges the handle to move from the projected state to the folded state.

15. The image formation apparatus according to claim 12, wherein the interference member comprises a sub cover provided to the fixation unit and covering a part of the exposed part of the fixation unit, and the contact portion of the sub cover to the handle includes an inclined surface which urges the handle to move from the projected state to the folded state.

16. The image formation apparatus according to claim 15, wherein the contact portion of the handle to the sub cover includes an inclined surface which urges the handle to move from the projected state to the folded state.

17. The image formation apparatus according to claim 10, wherein the apparatus housing has a structure that allows the fixation unit is taken out from the apparatus housing through the opening of the stacker in an inclined manner inclined toward the front direction.

* * * * *